US012791027B2

(12) United States Patent
Liu et al.

(10) Patent No.: US 12,791,027 B2
(45) Date of Patent: Nov. 10, 2026

(54) COMPRESSION MECHANISM AND SCROLL COMPRESSOR

(71) Applicant: Copeland Climate Technologies (Suzhou) Co., Ltd., Suzhou (CN)

(72) Inventors: Xuan Liu, Suzhou (CN); Yuancan Fang, Suzhou (CN); Chong Zhang, Suzhou (CN); Pei Jin, Suzhou (CN); Ji Liang, Suzhou (CN)

(73) Assignee: Copeland Climate Technologies (Suzhou) Co., Ltd., Jiangsu (CN)

( * ) Notice: Subject to any disclaimer, the term of this patent is extended or adjusted under 35 U.S.C. 154(b) by 0 days.

(21) Appl. No.: 18/879,381

(22) PCT Filed: Jun. 30, 2023

(86) PCT No.: PCT/CN2023/104878
§ 371 (c)(1),
(2) Date: Dec. 27, 2024

(87) PCT Pub. No.: WO2024/002351
PCT Pub. Date: Jan. 4, 2024

(65) Prior Publication Data

US 2026/0002538 A1 Jan. 1, 2026

(30) Foreign Application Priority Data

Jun. 30, 2022 (CN) ..... 202210760021.8
Jun. 30, 2022 (CN) ..... 202210760025.6
(Continued)

(51) Int. Cl.
*F04C 29/12* (2006.01)
*F04C 18/02* (2006.01)
*F04C 28/00* (2006.01)

(52) U.S. Cl.
CPC ..... *F04C 29/12* (2013.01); *F04C 18/0215* (2013.01); *F04C 28/00* (2013.01); *F04C 2270/215* (2013.01)

(58) Field of Classification Search
CPC .... F04C 18/0215; F04C 23/008; F04C 18/02; F04C 29/12; F04C 18/0261; F04C 27/005;
(Continued)

(56) References Cited

U.S. PATENT DOCUMENTS 6,537,043 B1 * 3/2003 Chen ..... F04C 29/126 137/543.17
2003/0044296 A1 * 3/2003 Chen ..... F04C 29/126 418/270
(Continued)

FOREIGN PATENT DOCUMENTS

CN 1702328 A 11/2005
CN 101614206 A 12/2009
(Continued)

OTHER PUBLICATIONS

International Search Report of the ISA issued in PCT/CN2023/104878, mailed Sep. 15, 2023, ISA/CN.
(Continued)

*Primary Examiner* — Anthony Ayala Delgado
(74) *Attorney, Agent, or Firm* — Harness, Dickey & Pierce, P.L.C.

(57) ABSTRACT

A compression mechanism, and a scroll compressor, for the scroll compressor are provided, wherein the compression mechanism includes a movable scroll having a movable scroll end plate and a fixed scroll having a fixed scroll end plate. A movable scroll blade and a fixed scroll blade are engaged with each other to form a series of compression cavities between the movable scroll and the fixed scroll. A
(Continued)

series of compression cavities include a central compression cavity and fluid compression cavities located on the radial lateral side of the central compression cavity. The compression mechanism is provided with a drainage channel and a drainage control mechanism, which enables the drainage channel to selectively provide fluid communication between a first fluid compression cavity in the fluid compression cavities and the outside of the compression mechanism.

19 Claims, 18 Drawing Sheets

(30) Foreign Application Priority Data

Jun. 30, 2022 (CN) ..... 202221669933.6
Jun. 30, 2022 (CN) ..... 202221669977.9
Nov. 21, 2022 (CN) ..... 202211455002.0
Nov. 21, 2022 (CN) ..... 202223091279.8

(58) Field of Classification Search
CPC .... F04C 29/00; F04C 18/0253; F04C 29/124; F04C 29/0007; F04C 2210/26; F04C 28/24; F04C 15/06; F04C 18/0223; F04C 2/025; F04C 28/26; F04C 29/042; F04C 2240/30; F04C 2240/806; F04C 27/00; F04C 29/0057; F04C 29/04; F04C 23/00; F04C 28/10; F04C 29/02; F04C 29/028; F04C 29/126; F04C 29/128; F04C 14/26; F04C 18/0246; F04C 18/0292; F04C 2210/1022; F04C 2210/263; F04C 2230/21; F04C 2230/92; F04C 2240/20; F04C 2240/603; F04C 23/001; F04C 27/008; F04C 27/02; F04C 28/02; F04C 28/14; F04C 28/28; F04C 29/0021; F04C 29/0092; F04C 29/021; F04C 29/061; F01C 21/02; F01C 21/10
See application file for complete search history.

(56) References Cited

U.S. PATENT DOCUMENTS

| | | | | |
|---|---|---|---|---|
| 2006/0233657 | A1* | 10/2006 | Bonear ..... | F04C 28/28 418/55.6 |
| 2009/0297378 | A1 | 12/2009 | Stover et al. | |
| 2010/0135836 | A1 | 6/2010 | Stover et al. | |
| 2017/0306960 | A1 | 10/2017 | Pax et al. | |
| 2018/0209422 | A1 | 7/2018 | Joo et al. | |
| 2018/0216618 | A1 | 8/2018 | Jeong | |
| 2018/0363651 | A1 | 12/2018 | Seong et al. | |

FOREIGN PATENT DOCUMENTS

| | | | |
|---|---|---|---|
| CN | 102287371 | A | 12/2011 |
| CN | 102588277 | A | 7/2012 |
| CN | 202545247 | U | 11/2012 |
| CN | 103573619 | A | 2/2014 |
| CN | 104196725 | A | 12/2014 |
| CN | 108626116 | A | 10/2018 |
| CN | 211449024 | U | 9/2020 |
| CN | 214787979 | U | 11/2021 |
| CN | 217950683 | U | 12/2022 |
| CN | 217999879 | U | 12/2022 |
| CN | 218669812 | U | 3/2023 |
| JP | H0533786 | A | 2/1993 |
| JP | 2012251526 | A | 12/2012 |
| WO | 2010065720 | A2 | 6/2010 |

OTHER PUBLICATIONS

Chinese First Office Action regarding Application No. 202210760021.8, dated Apr. 15, 2026, with English translation.
Extended European Search Report regarding Application No. 23830514.8, dated May 4, 2026.

* cited by examiner

COMPRESSION MECHANISM AND SCROLL COMPRESSOR

CROSS-REFERENCE TO RELATED APPLICATIONS

The present application is the national phase of International Application No. PCT/CN2023/104878 titled "COMPRESSION MECHANISM, SCROLL COMPRESSOR AND CONTROL METHOD FOR SCROLL COMPRESSOR" and filed on Jun. 30, 2023, which claims priorities to the Chinese patent application No. 202210760021.8, titled "COMPRESSION MECHANISM, SCROLL COMPRESSOR AND CONTROL METHOD FOR SCROLL COMPRESSOR", filed on Jun. 30, 2022 with the China National Intellectual Property Administration; Chinese patent application No. 202221669977.9, titled "COMPRESSION MECHANISM AND SCROLL COMPRESSOR", filed on Jun. 30, 2022 with the China National Intellectual Property Administration; Chinese patent application No. 202210760025.6, titled "COMPRESSION MECHANISM AND SCROLL COMPRESSOR", filed on Jun. 30, 2022 with the China National Intellectual Property Administration; Chinese patent application No. 202221669933.6, titled "COMPRESSION MECHANISM AND SCROLL COMPRESSOR", filed on Jun. 30, 2022 with the China National Intellectual Property Administration; Chinese patent application No. 202211455002.0, titled "COMPRESSION MECHANISM AND SCROLL COMPRESSOR", filed on Nov. 21, 2022 with the China National Intellectual Property Administration; and Chinese patent application No. 202223091279.8, titled "COMPRESSION MECHANISM AND SCROLL COMPRESSOR", filed on Nov. 21, 2022 with the China National Intellectual Property Administration, which are incorporated herein by reference in their entireties.

FIELD

The present disclosure relates to a compression mechanism, and in particular to a compression mechanism and a scroll compressor with a discharge design and to a discharge control method for a scroll compressor.

BACKGROUND

The contents of this section provide only background information relevant to the present disclosure, which may not constitute the prior art.

It is known that scroll compressors belong to compression machinery based on volumetric compression. The scroll compressor includes a compression mechanism composed of a fixed scroll and an orbiting scroll. Generally, the fixed scroll and the orbiting scroll each includes a scroll blade, and the two scroll blades mesh with each other to form a series of compression chambers between the fixed scroll and the orbiting scroll to compress the working medium, and high-pressure gas obtained by the compression is discharged through an exhaust port at the center of the fixed scroll.

Ordinary scroll compressors usually are designed axially flexibly, that is, the fixed scroll and the orbiting scroll can be separated from each other by a certain distance in an axial direction, in such way, for example, the pressure in a compression chamber is too high, a high-pressure fluid (such as a gaseous refrigerant) can be unloaded or excessive liquid (such as a liquid refrigerant in the early stage of the start-up of the compressor) in the compression chamber can be discharged.

However, for large-displacement scroll compressors, an axial separation distance of the compression mechanism is limited or even the compression mechanism is not designed axially flexibly, thus the liquid in the compression chamber cannot be discharged in time, and it is easy to cause the scroll blade to be subjected to great impact force under a liquid-carrying operating condition, resulting in the breakage of the scroll blade. In addition, an enormous torque may be generated at the moment of the start-up of the scroll compressor, resulting in a certain impact on a motor, which easily affect the service life of the motor operating under a frequent start-stop operating condition.

Therefore, there is a need to improve the discharge design of the scroll compressors, especially the large-displacement scroll compressors.

SUMMARY

An object of the present disclosure is to provide a compression mechanism and a scroll compressor with a new discharge design, the compression mechanism is provided with a discharge passage and a discharge control mechanism, which can discharge an excessive amount of liquid in the compression chamber in time to effectively avoid the damage of liquid strike to the scroll compressor, and can reduce the starting torque of the compressor, can reduce the impact load on a motor, thereby increasing the service life of the motor.

Another object of the present disclosure is to provide a compression mechanism and a scroll compressor with a new discharge design, the compression mechanism is provided with a discharge passage and a passive discharge control mechanism, which can not only effectively cope with a liquid-carrying operating condition of the compressor, but also it is not required to provide a separate power source for the liquid discharge and to introduce fluid from the exterior of the compression mechanism to generate a pressure difference, thereby having a simple structure, less parts, easy processing and low costs.

Another object of the present disclosure is to provide a compression mechanism and a scroll compressor with a new discharge design. In the compression mechanism, a movable blocking member is controlled by a back pressure chamber and a pressure tapping hole, which can not only effectively cope with the liquid-carrying operating condition of the compressor, but also it is not required to provide a specified control chamber and control passage for the movable blocking member, thereby having a simple structure, less parts, easy processing and low costs.

Another object of the present disclosure is to provide a compression mechanism and a scroll compressor with a new discharge mechanism. The compression mechanism is provided with, in a fixed scroll, a discharge passage through which a suction chamber or an intermediate compression chamber close to a suction chamber can be communicated with the exterior of the compression mechanism, thereby excessive liquid in the compression chamber being able to discharge in time and the damage of liquid strike to the scroll compressor during the start-up being effectively avoid.

Another object of the present disclosure is to provide a discharge control method for a scroll compressor. With the method, the starting torque of the compressor can be reduced excessive starting torque of the motor can be avoid, the impact load on the motor can be reduced and the service life of the motor can be improved, by reasonably controlling the opening and closing period of the discharge passage.

According to an aspect of the present disclosure, a compression mechanism is provided. The compression mechanism includes: a scroll component including an orbiting scroll and a fixed scroll meshing with each other. The scroll component includes a scroll end plate and a scroll blade formed on one side of the scroll end plate. The scroll end plate includes an orbiting scroll end plate and a fixed scroll end plate, and the scroll blade includes an orbiting scroll blade formed on a side of the orbiting scroll end plate and a fixed scroll blade formed on a side of the fixed scroll end plate. The orbiting scroll blade and the fixed scroll blade mesh with each other to form a series of compression chambers between the orbiting scroll and the fixed scroll. The series of compression chambers include a central compression chamber and a fluid compression chamber located at a radially outer side of the central compression chamber. The compression mechanism is provided with a discharge passage and a discharge control mechanism. The discharge control mechanism allows the discharge passage to selectively provide fluid communication between a discharge fluid compression chamber (a first fluid compression chamber) of the fluid compression chambers and an exterior of the compression mechanism.

Optionally, the first fluid compression chamber is a suction chamber of the fluid compression chamber or an intermediate compression chamber close to the suction chamber of the fluid compression chambers.

Optionally, the discharge control mechanism is configured to provide a pressure difference. Optionally, the discharge control mechanism is configured to generate the pressure difference by only using a fluid from the compression mechanism.

Optionally, the discharge control mechanism further includes a movable blocking member, which is arranged in the discharge passage and is movable under the action of the pressure difference between an open position at which the fluid communication is provided and a closed position at which the fluid communication is not provided.

Optionally, the discharge passage is provided in the scroll component and is configured to include a blocking member passage portion extending through the scroll component substantially along an axis direction of the compression mechanism, and a liquid discharge portion through which the blocking member passage portion is in communication with the exterior of the compression mechanism. The blocking member passage portion includes a blocking member passage section for accommodating the movable blocking member and a liquid entry section through which the blocking member passage section is in communication with the first fluid compression chamber.

Optionally, the discharge control mechanism further includes a cover member which is configured to cover and seal the blocking member passage section, so that a pressure control chamber is formed in a region between the cover member and the movable blocking member in the blocking member passage section.

Optionally, the discharge control mechanism is configured to passively generate the pressure difference.

Optionally, the discharge control mechanism is provided with a throttling expansion structure, configured to expand and vaporize a liquid fluid from the compression mechanism to passively generate the pressure difference.

Optionally, the discharge control mechanism further includes a pressure control passage provided in the scroll component, one end of the pressure control passage is in communication with a second fluid compression chamber of the fluid compression chambers, and the other end of the pressure control passage is in communication with the pressure control chamber, the first fluid compression chamber is closer to a radially outer side of the compression mechanism than the second fluid compression chamber, and the throttling expansion structure is provided in the pressure control passage.

Optionally, the pressure control passage includes a pressure tapping hole extending substantially along the axis direction of the compression mechanism, and in the axis direction of the compression mechanism, the pressure tapping hole includes a first section connected to the second fluid compression chamber and a second section connected to the first section. A flow cross-sectional area of the first section is less than a flow cross-sectional area of the second section so that the throttling expansion structure is formed at a joint of the first section and the second section; and/or the discharge control mechanism includes an expansion hole, a first channel groove and a second channel groove provided in the scroll component, the pressure tapping hole is connected with the expansion hole through the first channel groove, the expansion hole is connected with the pressure control chamber through the second channel groove, and a flow cross-sectional area of the expansion hole is greater than a flow cross-sectional area of the first channel groove, so that the throttling expansion structure is formed at a joint of the expansion hole and the first channel groove.

Optionally, the pressure tapping hole, the expansion hole and the blocking member passage section are arranged in different planes extending substantially along the axis direction of the compression mechanism.

Optionally, the scroll component further includes a hub portion formed on a side, opposite to the scroll blade, of the scroll component end plate, and the discharge passage and the discharge control mechanism are provided at the hub portion.

Optionally, the discharge control mechanism includes a single pressure tapping hole, and the discharge passage includes two groups of discharge passages substantially symmetrically arranged on two sides of a central axis of the compression mechanism, and the single pressure tapping hole is provided between the two groups of discharge passages and is respectively in communication with the pressure control chamber in each of the two groups of discharge passages.

Optionally, the discharge control mechanism is configured to actively generate the pressure difference.

Optionally, the discharge control mechanism further includes a pressure control passage provided in the scroll component and a solenoid valve arranged in an exterior of the scroll component, the pressure control passage includes a first pressure control passage and a second pressure control passage extending substantially in a direction transverse to the axis direction of the compression mechanism, the first pressure control passage is connected to the solenoid valve and is in communication with the pressure control chamber, and the second pressure control passage is connected to the solenoid valve and is in communication with the central compression chamber or the fluid compression chamber located close to the central compression chamber.

Optionally, the solenoid valve has a first state and a second state, in a liquid-carrying operating condition of the compression mechanism, the solenoid valve is in the first state so as to communicate the first pressure control passage with the exterior of the compression mechanism, and in a non-liquid-carrying operating condition of the compression mechanism, the solenoid valve is in the second state so as to communicate the first pressure control passage with the second pressure control passage.

Optionally, the compression mechanism includes a back pressure chamber, the scroll end plate includes a first side on which the scroll blade is formed; the back pressure chamber is formed on a second side, opposite to the first side, of the scroll component to provide an axial sealing pressure to the scroll component, the back pressure chamber forms a pressure control chamber of the pressure control mechanism, a first end surface of the movable blocking member is exposed to the back pressure chamber, and a second end surface, opposite to the first end surface, of the movable blocking member is exposed to the first fluid compression chamber.

Optionally, the discharge passage is provided in the scroll component end plate, the blocking member passage portion extends from the first side to the second side of the scroll component end plate, and a pressure tapping opening, located on the second side of the scroll component end plate, of the blocking member passage portion is provided in the back pressure chamber. Optionally, the movable blocking member is configured as a piston, a piston end cover is further provided at the pressure tapping opening of the blocking member passage portion, the piston end cover is fixed to the scroll component end plate to stop the piston, a through hole is formed in the piston end cover, and a first end, serving as the first end surface, of the piston is exposed to the back pressure chamber through the through hole.

Optionally, the back pressure chamber is in communication with a second fluid compression chamber of the fluid compression chambers through a pressure tapping hole provided in the scroll component end plate, and the first fluid compression chamber is closer to a radially outer side of the compression mechanism than the second fluid compression chamber.

Optionally, the scroll component includes a hub portion extending from the second side of the scroll component end plate and a ring-shaped wall formed around the hub portion, and the back pressure chamber is formed by a space enclosed by the scroll component end plate, the hub portion and the ring-shaped wall and is sealed by a sealing assembly arranged in the space.

Optionally, the blocking member passage portion is configured as a single passage, and the liquid discharge portion is configured as a single passage or multiple passages, and the liquid discharge portion is in communication with the blocking member passage portion through a corresponding liquid outlet formed on a side part of the blocking member passage portion.

Optionally, the liquid discharge portion is configured to have a constant flow area, or is configured to have a flow area gradually increased in a direction extending from the liquid outlet towards the exterior of the compression mechanism.

Optionally, the scroll component further includes a hub portion formed on a side, opposite to the scroll blade, of the scroll component end plate, and the discharge passage and the discharge control mechanism are provided at a radially outer side of the hub portion.

Optionally the discharge passage includes two groups of discharge passages arranged substantially symmetrically on two sides of a central axis of the compression mechanism; or the discharge passage includes two groups of discharge passages arranged near a suction inlet of the compression mechanism.

Optionally, the discharge passage includes multiple discharge passages, and pressure control chambers within the multiple discharge passages are in communication with each other through a communication groove.

Optionally, a sealing member is provided between the movable blocking member and the blocking member passage section, where the sealing member is configured to always isolate the liquid discharge portion from the pressure control chamber wherever the movable blocking member is located.

Optionally, a sealing seat is formed at a base of the blocking member passage section, and the sealing seat is configured to be fitted with a lower end surface of the movable blocking member to form sealing against the liquid entry section.

Optionally, the discharge passage is configured in such a way that, when viewed in the axis direction of the compression mechanism, a part of the liquid entry section is overlapped with a part, where the liquid entry section is formed, of the orbiting scroll blade of the orbiting scroll, or overlapped with a part, where the liquid entry section is formed, of the fixed scroll blade of the fixed scroll.

According to another aspect of the present disclosure, a scroll compressor is further provided. The scroll compressor includes the compression mechanism described above.

According to yet another aspect of the present disclosure, a scroll compressor is further provided. The scroll compressor further includes a controller. The controller is configured to control a solenoid valve, arranged outside the scroll component, of the compression mechanism and thus to control a movable blocking member arranged in the discharge passage, so that during start-up of the scroll compressor or in a case that it is detected that the scroll compressor is in a liquid-carrying operating condition, the discharge passage provides the fluid communication.

According to still yet another aspect of the present disclosure, a control method for a scroll compressor is further provided. The control method includes: during start-up of the scroll compressor or in a case that it is detected that the scroll compressor is in a liquid-carrying operating condition, switching, by a controller of the scroll compressor, a solenoid valve provided outside the scroll component to a first state. In the first state, the solenoid valve, by controlling a differential pressure, controls the movable blocking member provided in the discharge passage to be in an open position, so that the discharge passage provides the fluid communication.

The compression mechanism and the scroll compressor according to the present disclosure are newly designed, which can not only discharge the excessive liquid in the compression chamber in time, effectively prevents the damage of liquid strike to the compressor, especially for the start-up liquid-carrying operating condition of the compressor. The starting torque of the compressor can further reduced and the service life of the motor can be effectively extended. The discharge control method for a scroll compressor according to the present disclosure uses an optimized control logic, which can reduce the starting torque of the compressor, and effectively extend the service life of the motor. In addition, the compression mechanism and the scroll compressor according to the present disclosure use a new discharge control mechanism, which eliminates the need for a separate power source. It is not required to introduce fluid from the exterior of the compression mechanism to generate a pressure difference, and even it is not required to provide a separate control chamber and control passage for the movable blocking member, thereby having a simple structure, less parts, high reliability, simple production and manufacturing, and low costs.

BRIEF DESCRIPTION OF THE DRAWINGS

The features and advantages of one or more embodiments of the present disclosure will become more easily understood by the following descriptions with reference to the accompanying drawings. In the drawings.

DETAILED DESCRIPTION OF THE EMBODIMENTS

Exemplary embodiments will be described more fully below with reference to the accompanying drawings.

The exemplary embodiments are provided so that the present disclosure will be exhaustive and will more fully convey the scope to those skilled in the art. Many specific details such as examples of specific components, devices, and methods are set forth to provide a thorough understanding of the embodiments of the present disclosure. It will be clear to those skilled in the art that the exemplary embodiments may be implemented in many different forms without using specific details, none of which should be construed as limiting the scope of the present disclosure. In some exemplary embodiments, well-known processes, well-known device structures, and well-known technologies are not described in detail.

Figure 1:
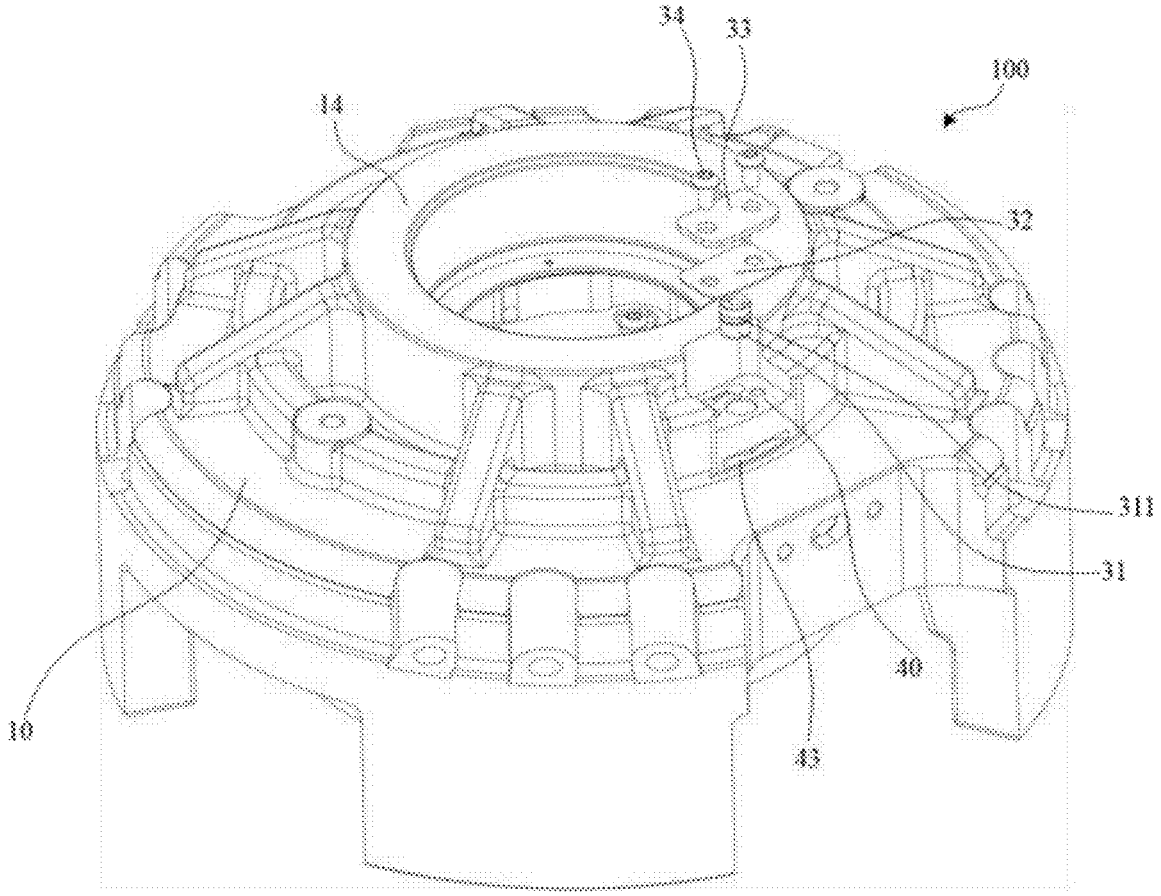
FIG. 1 is an exploded perspective view of a compression mechanism of a scroll compressor according to a first embodiment of the present disclosure, in which an orbiting scroll is not shown.

The overall structure of a scroll compressor according to a first embodiment of the present disclosure, in particular a compression mechanism of the scroll compressor, is described below with reference to FIG. 1. In general, the scroll compressor includes a compression mechanism, a motor, a rotating shaft, a main bearing seat, and a housing that defines an internal space for accommodating the above components. A suction pressure region and an exhaust pressure region are defined in the internal space of the housing.

The compression mechanism CM includes a fixed scroll 100 and an orbiting scroll 200. The orbiting scroll 200 includes an orbiting scroll end plate 20 and an orbiting scroll blade 22 formed on one side of the orbiting scroll end plate. The fixed scroll 100 includes a fixed scroll end plate 10, a fixed scroll blade 12 extending from a first side of the fixed scroll end plate 10, and a hub portion 14 extending from a second side, opposite to the first side, of the fixed scroll end plate 10. An exhaust port is formed at the center of the fixed scroll end plate 10, and the hub portion 14 is provided around the exhaust port. The fixed scroll blade 12 and the orbiting scroll blade 22 can mesh with each other, so that a series of compression chambers C are formed between the fixed scroll blade 12 and the orbiting scroll blade 22 when the scroll compressor is operating. The series of compression chambers C include a central compression chamber CO, located in the center of the fixed scroll 100, in communication with the exhaust port located in the center of the fixed scroll end plate 10 and a fluid compression chamber CL located at the radially outer side of the central compression chamber CO. The fluid compression chamber CL includes a suction chamber CI, located at a radially outer side portion of the fixed scroll 100, in communication with a suction inlet of the fixed scroll 100 and multiple intermediate compression chambers located between the central compression chamber and the suction chamber CI. The motor is configured to rotate a rotating shaft. The rotating shaft drives the orbiting scroll 200 to revolve around the fixed scroll 100. The refrigerant fluid enters the compression mechanism from the suction pressure region and passes through the series of compression chambers for compressing, and is exhausted from the exhaust port at the center of fixed scroll end plate 10 to the exhaust pressure region.

In order to realize compression of the refrigerant fluid, effective sealing is required between the fixed scroll 100 and the orbiting scroll 200.

On the one hand, when the scroll compressor is operating normally, axial sealing is required between a tip of the fixed scroll blade 12 and the orbiting scroll end plate and between a tip of the orbiting scroll blade 22 and the fixed scroll end plate 10. When the pressure in the compression chamber of the scroll compressor is excessive, the fluid in the compression chamber can be leaked to a low-pressure side for unloading through a clearance between the tip of the fixed scroll blade 12 and the orbiting scroll end plate and a clearance between the tip of the orbiting scroll blade 22 and the fixed scroll end plate 10, thereby providing axial flexibility to the scroll compressor.

Figure 9:
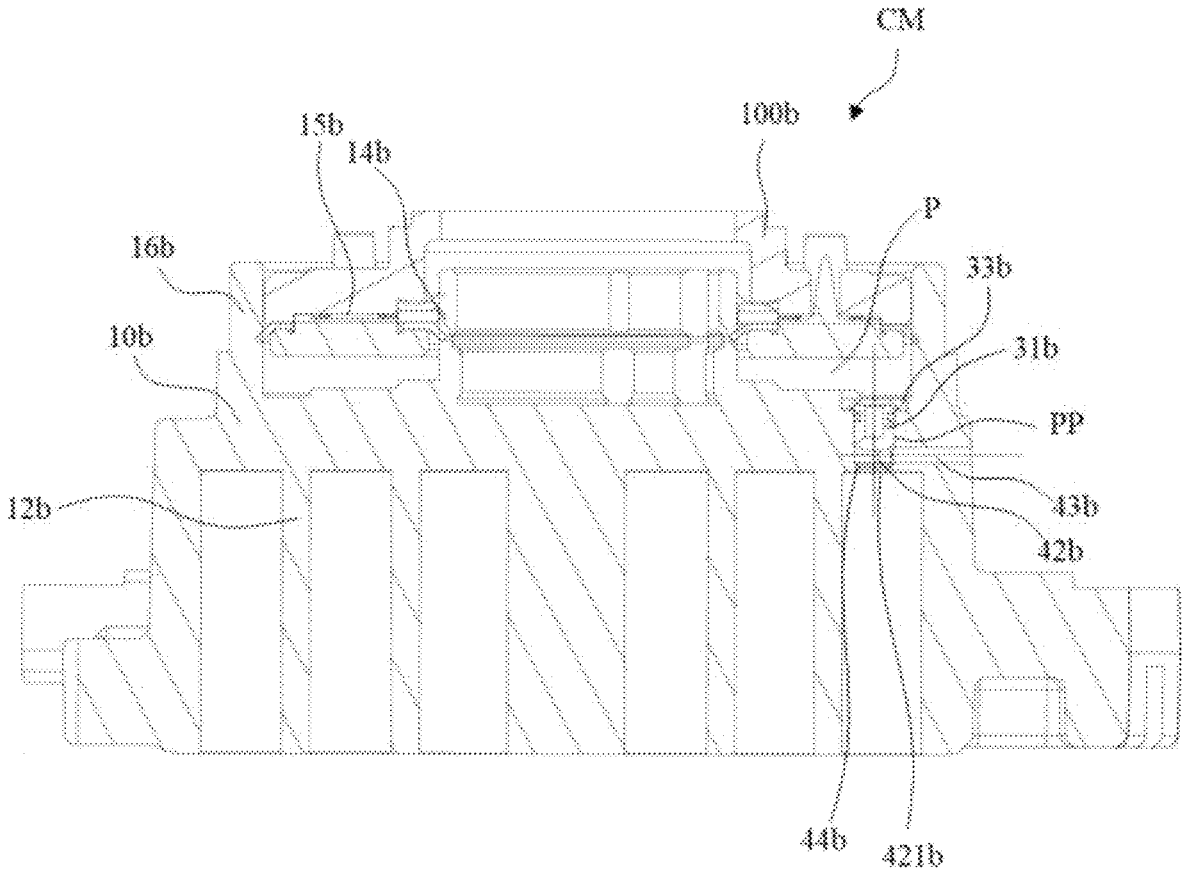
FIG. 9 is a longitudinal sectional view of a compression mechanism of a scroll compressor in a discharging state according to a third embodiment of the present disclosure, in which an orbiting scroll is not shown.
Figure 10:
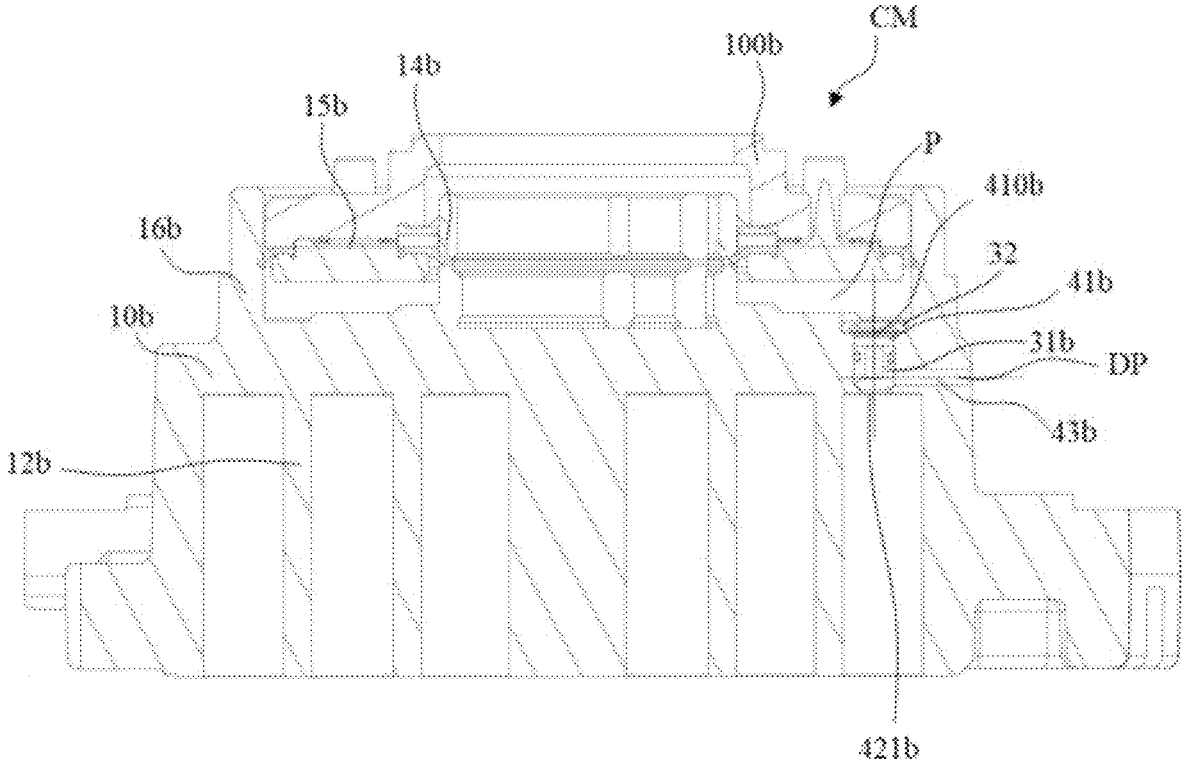
FIG. 10 is a longitudinal sectional view of the compression mechanism of the scroll compressor in a non-discharging state according to the third embodiment of the present disclosure, in which an orbiting scroll is not shown.
Figure 11:
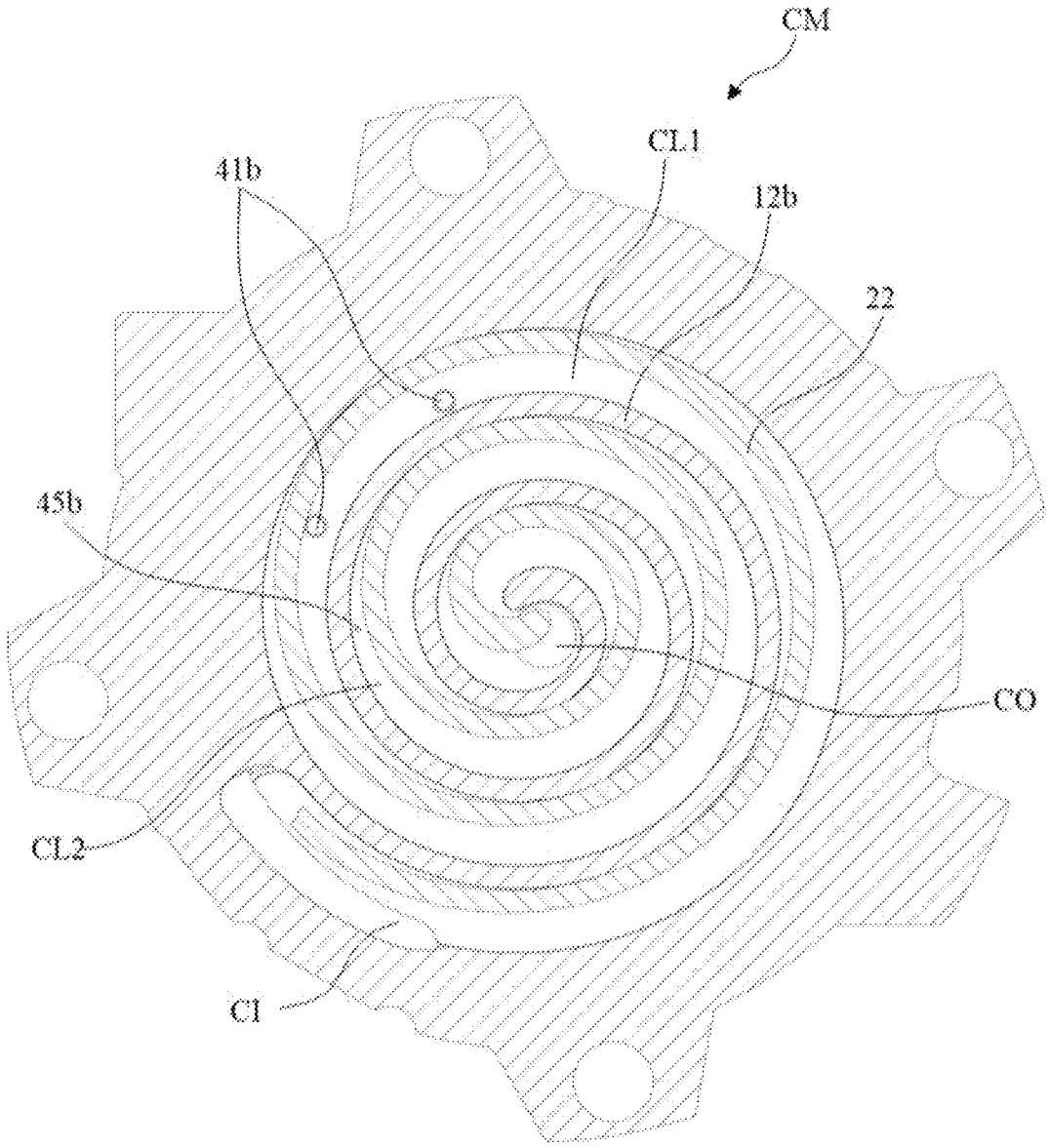
FIG. 11 is a cross-sectional view of the compression mechanism of the scroll compressor according to the third embodiment of the present disclosure.

In order to achieve the axial sealing between the fixed scroll and the orbiting scroll, as shown in FIGS. 9, 10, and 11, a back pressure chamber P is usually provided on the second side of the fixed scroll end plate 10*b*. The fixed scroll 10*b* further includes a ring-shaped wall 16*b*, formed around the outer periphery of the hub portion 14*b*, extending from the second side of the fixed scroll end plate 10*b*. The back pressure chamber P is formed by a space enclosed by the fixed scroll end plate 10*b*, the hub portion 14*b* and the ring-shaped wall 16*b* and is sealed by a sealing assembly 15*b* provided within the back pressure chamber P. The back pressure chamber P is in fluid communication with an intermediate compression chamber (i.e., a second fluid compression chamber CL2, shown in FIG. 11) of the series of compression chambers between the orbiting scroll and the fixed scroll 100*b* through a substantially axially extending pressure tapping hole 45*b* (shown in FIG. 11) provided in the fixed scroll end plate 10*b*, thereby providing an axial sealing pressure to the fixed scroll 100*b*.

On the other hand, when the scroll compressor is operating normally, radial sealing is also required between a side surface of the fixed scroll blade 12*b* and a side surface of the orbiting scroll blade 22. The radial sealing between the two side surfaces is usually realized by a centrifugal force of the orbiting scroll during operation and a driving force provided by the rotating shaft. When incompressible foreign matter (such as a small amount of solid impurities and liquid refrigerant) enters the compression chamber and gets stuck between the fixed scroll blade 12*b* and the orbiting scroll blade 22, the fixed scroll blade 12*b* and the orbiting scroll blade 22 can temporarily be separated from each other in a radial direction to allow the foreign matter to pass through, which prevents damage to the fixed scroll blade 12*b* and the orbiting scroll blade 22, thereby providing radial flexibility to the scroll compressor.

However, under certain operating conditions, especially when the scroll compressor is started in a liquid-carrying operating condition, with the increase of sections of the charge, the flexible design of the scroll compressor allows limited liquid refrigerant to pass through, resulting in a great impact force of the liquid refrigerant on the compression mechanism, causing damage and crack of the compression mechanism. In addition, at the moment of the start-up of the scroll compressor, a large torque may be generated, which has a certain impact on the motor, thereby affecting the service life of the motor (especially in a case of a frequent start-stop condition).

Figure 3A:
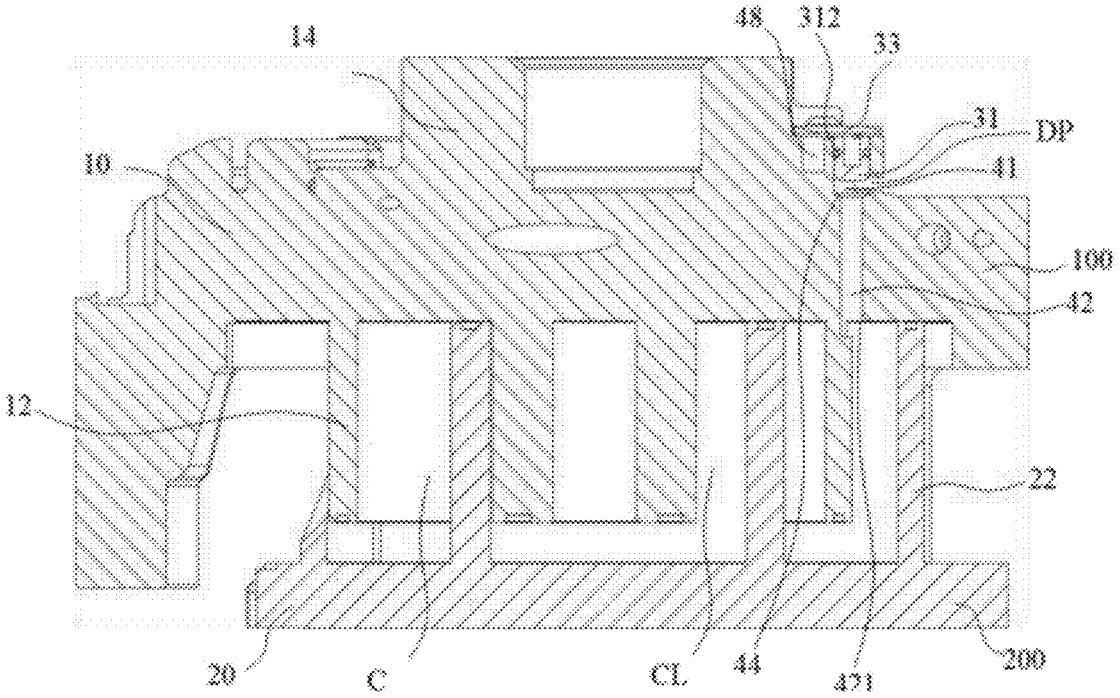
FIGS. 3*a* and 3*b* are longitudinal sectional views of the compression mechanism of the scroll compressor in a discharging state and in a non-discharging state according to the first embodiment of the present disclosure, respectively.
Figure 3B:
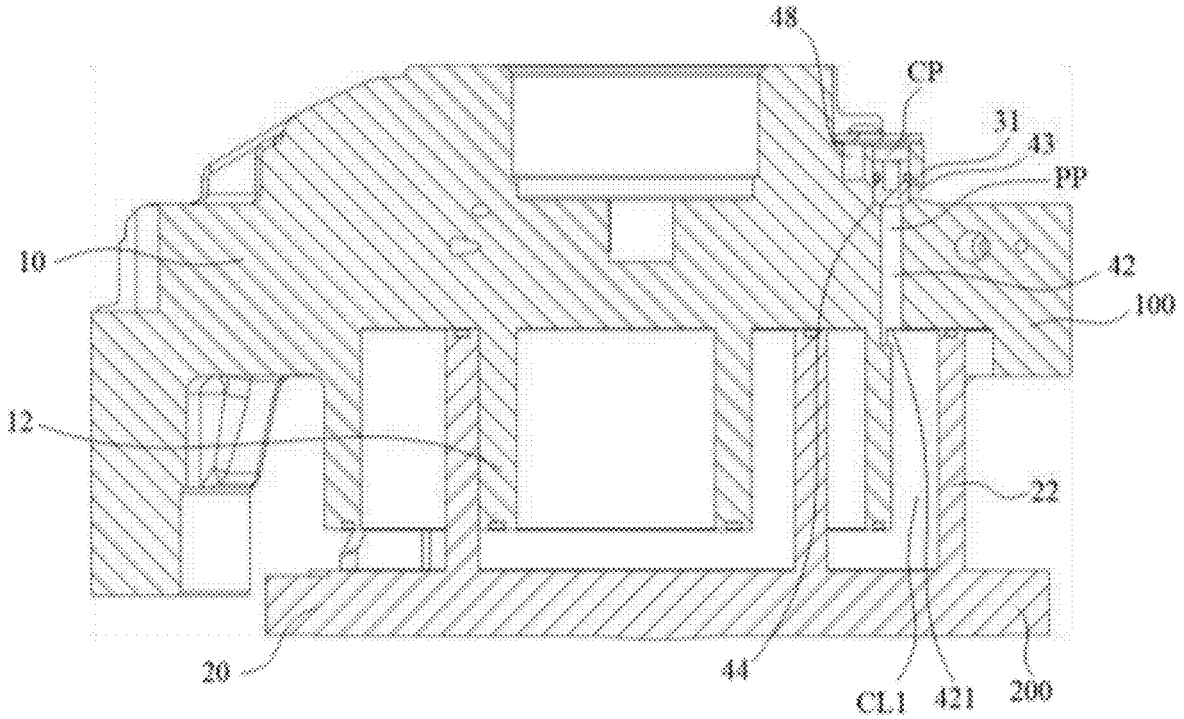

In order to realize the discharge of the compression mechanism, a discharge mechanism platform 40 is formed on the radial outer side of the hub portion 14 of the fixed scroll 100. The discharge mechanism platform 40 is higher than the second side surface of the fixed scroll end plate 10. A discharge passage DP is formed at the discharge mechanism platform 40. As shown in FIGS. 3*a* and 3*b*, the discharge passage DP is provided in the fixed scroll 100 and is configured to include a blocking member passage portion PP extending through the fixed scroll 100 substantially along an axis direction of the compression mechanism, and a liquid discharge portion 43 through which the blocking member passage portion PP is in communication with the exterior of the compression mechanism CM. The blocking member passage portion PP includes a blocking member passage section (piston passage section) 41 and a liquid entry section 42 in the axis direction of the compression mechanism. One end of the liquid entry section 42 is connected with the piston passage section 41, and the opposite end of the liquid entry section 42 is communication with the suction chamber CI. The first end of the piston passage section 41 forms an opening on the discharge mechanism platform 40, and the second end, opposite to the first end, of the piston passage section 41 is connected with the liquid entry section 42. The side part of the piston passage section 41 is further provided with a liquid outlet in communication with the liquid discharge portion 43 and thus in communication with the suction pressure region external to the compression mechanism.

In order to increase the flow area to allow the liquid to be discharged more smoothly, the liquid discharge portion 43 may preferably be configured as an elongated groove extending from the side of the piston passage section 41 away from the piston passage section 41 along a direction tangent to a side wall of the piston passage section 41. Furthermore, preferably, the liquid entry section 42 may be configured in such a way that a part of the liquid entry section 42 is overlapped with the fixed scroll blade 12, when viewed in the axial direction of the compression mechanism. With such configuration, on the one hand, the flow area of liquid inlet of the liquid entry section can be further increased to allow the liquid to enter the discharge passage more quickly, and on the other hand, the location design of the discharge passage can be facilitated while ensuring the functionality of the liquid inlet.

Figure 2:
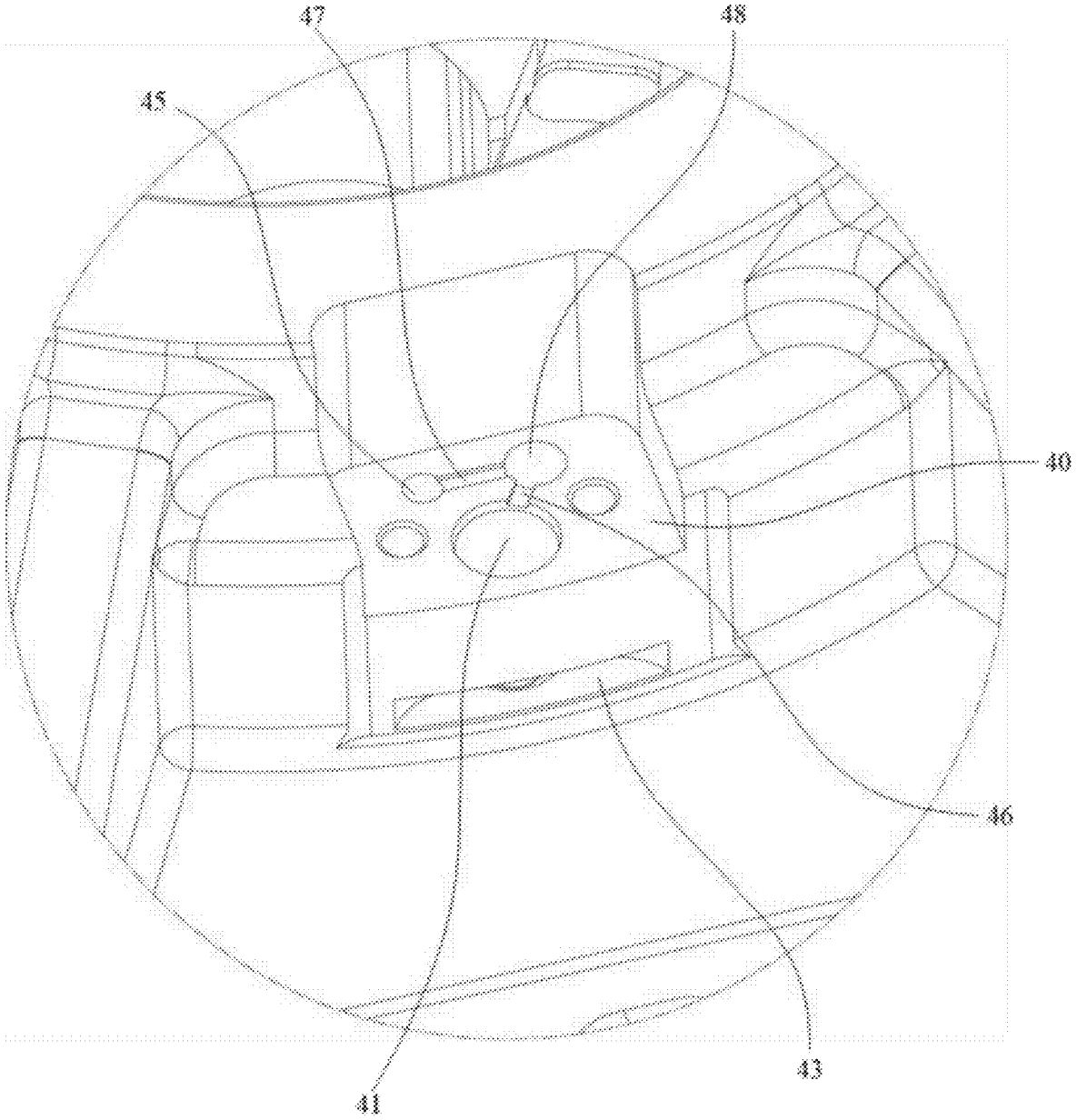
FIG. 2 is a detailed enlarged diagram of the compression mechanism of the scroll compressor according to the first embodiment of the present disclosure, in particular showing partial features of a discharge passage and a discharge control mechanism.

The compression mechanism further includes a discharge control mechanism, provided at the discharge mechanism platform 40, for controlling the opening and closing of the discharge passage. The discharge control mechanism passively generates a pressure difference, allowing the discharge passage to selectively provide fluid communication between the suction chamber CI and the suction pressure region external to the compression mechanism through the discharge control mechanism. Herein, "passive" can refer to that the entire discharge control mechanism generates a pressure difference without any components that require electricity/power, such as a solenoid valve, and automatically utilizes the fluid in the compression mechanism to form a pressure difference, so as to achieve automatic discharge. As shown in FIG. 2, the discharge control mechanism mainly includes a movable blocking member (such as a piston or valve sheet) 31, a cover member, a fixing member 34, and a pressure tapping hole 45 and an expansion hole 48. The piston 31 is accommodated in the piston passage section 41 of the discharge passage and is movable between the open and closed positions along the piston passage section 41. Preferably, a lower end surface of the piston 31 is configured as a conical, spherical or planar surface, a sealing seat 44 is formed at a base of the piston passage section 41, and the lower end surface of the piston 31 can be fitted with the sealing seat of the piston passage section 41 to form sealing against the liquid entry section 42. It can further be understood by those skilled in the art that the present disclosure is not limited to the piston for the opening and closing of the discharge passage, but may use any other component that allows to perform control by using the pressure difference, for example, an elastic valve sheet capable of opening and closing under the action of pressure difference.

The cover member includes a gasket 32 and a cover plate 33. By inserting the fixing member 34, such as a screw, sequentially through mounting holes on the cover plate 33 and on the gasket 32 and into a mounting hole at the discharge mechanism platform 40, the gasket 32 and the cover plate 33 are successively mounted and fixed to the discharge mechanism platform 40 and cover on the piston passage section 41 of the discharge passage to form sealing, thereby a pressure control chamber CP being formed in a region between the cover member and the piston 31 in the piston passage section 41. By regulating the pressure in the pressure control chamber CP to generate the differential pressure, the piston 31 can be moved to the open position or the closed position depending on needs.

Figure 4:
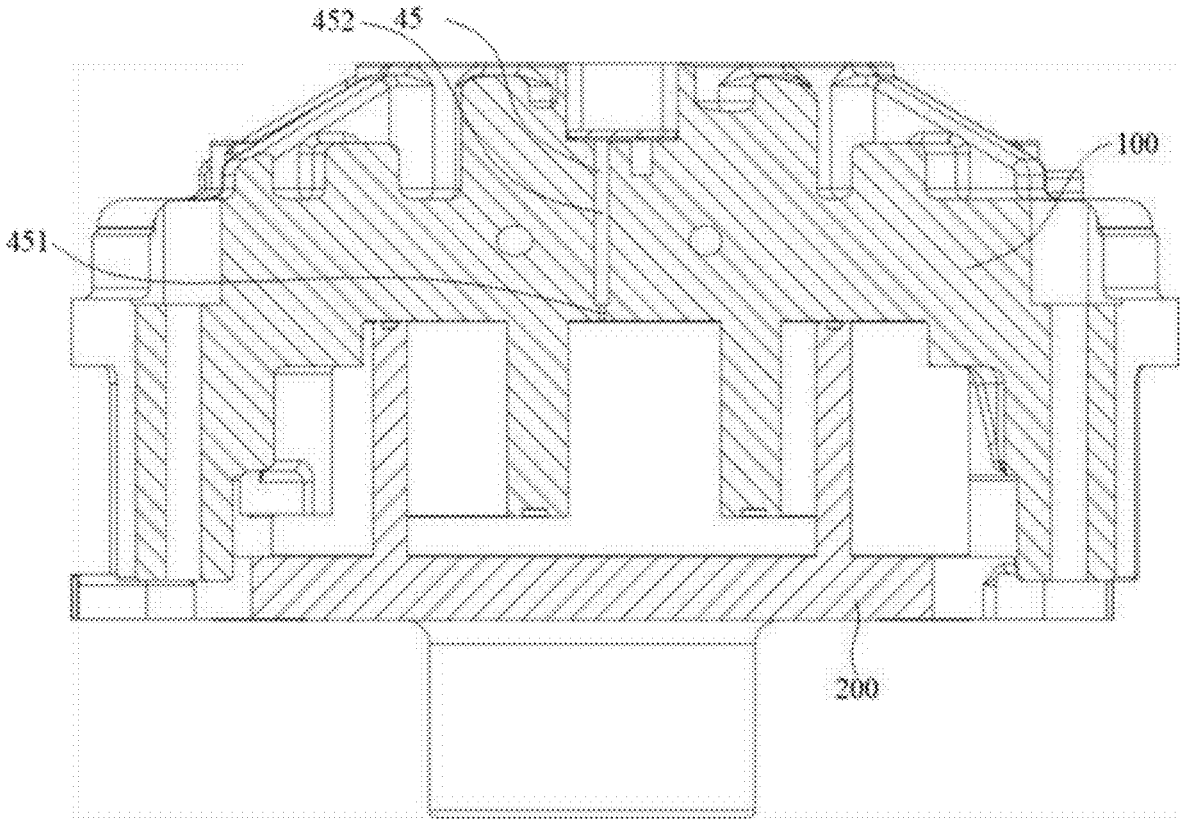
FIG. 4 is a longitudinal sectional view in another section of the compression mechanism of the scroll compressor according to the first embodiment of the present disclosure, showing a pressure tapping hole.

As shown in FIG. 4, the pressure tapping hole 45 extends substantially along the axis direction of the compression mechanism to form in the fixed scroll 100. The first end of the pressure tapping hole 45 is in communication with an intermediate compression chamber located at the radially inner side of the suction chamber CI, and the second end, opposite to the first end, of the pressure tapping hole 45 forms an opening on the discharge mechanism platform 40. With reference to FIGS. 3*a* and 3*b*, the expansion hole 48 is configured as a blind hole, formed in the fixed scroll 100, extending substantially along the axis direction of the compression mechanism, and one end of expansion hole 48 forms an opening on the discharge mechanism platform 40. As shown in FIG. 2, openings formed by the pressure tapping hole 45, the expansion hole 48 and the piston passage section 41 of the discharge passage on the discharge mechanism platform 40 are successively connected through a first channel groove 47 and a second channel groove 46 formed at the discharge mechanism platform 40. Thus, the second end of the pressure tapping hole 45 is indirectly in communication with the pressure control chamber CP. In the first embodiment of the present disclosure, the first channel groove 47 connects the pressure tapping hole 45 and the expansion hole 48, and the second channel groove 46 connects the expansion hole 48 and the pressure control chamber CP. The pressure tapping hole 45, the first channel groove 47, the expansion hole 48, and the second channel groove 46 together constitute a pressure control passage for directing fluid from an intermediate compression chamber located at the radially inner side of the suction chamber CI to the pressure control chamber CP.

More specifically, as shown in FIG. 2, the "flow cross-sectional area" herein refers to the area of the cross-section perpendicular to the flow direction of the fluid, and the flow cross-sectional area of the expansion hole 48 is significantly greater than that of the first channel groove 47. In other words, the pressure control passage is formed with a throttling expansion structure at a joint of the first channel groove 47 and the expansion hole 48.

As shown in FIG. 4, the pressure tapping hole 45 also has the throttling expansion structure. In particular, the pressure tapping hole 45 includes a first section 451 having a first end and a second section 452 having a second end, in the flow direction of the fluid (in this embodiment, in the axis direction of the compression mechanism). The first section 451 is interconnected with the second section 452. A throttling expansion structure with a suddenly increased flow cross-sectional area is formed at the joint of the first section 451 and the second section 452. In other words, the flow cross-sectional area of the second section 452 is significantly greater than that of the first section 451.

The operating principle of the discharge control mechanism of the scroll compressor is described below with reference to FIGS. 3*a* and 3*b*. As shown in FIG. 3*a*, when there is too much liquid in the compression chamber of the scroll compressor to be discharged, due to the incompressibility of the liquid, the compression chambers, including the suction chamber CI, are filled with isobaric liquid. The liquid in the suction chamber CI is pushed and squeezed by the scroll blade and enters the liquid entry section 42 and contacts with the lower end surface of the piston 31, exerting a thrust force on the lower end surface of the piston 31. The liquid in the intermediate compression chamber located at the radially inner side of the suction chamber CI enters the pressure tapping hole 45. Since the flow cross-sectional area of the first section 451 of the pressure tapping hole 45 is much less than that of the second section 452, the liquid, when flowing through the joint of the first section 451 and the second section 452, is transformed into a gas or gas-liquid mixture and the pressure is reduced due to sudden volume expansion, and the gas or gas-liquid mixture is further vaporized with the pressure being reduced due to sudden volume expansion again when it enters the expansion hole 48 through the first channel groove 47, and finally enters the pressure control chamber CP through the second channel groove 46. Therefore, the pressure exerted by the fluid entering into the pressure control chamber CP on the upper end surface of the piston 31 is much less than the liquid thrust exerted on the lower end surface of the piston 31. The piston 31 moves upward to the open position under the action of the pressure difference, the lower end surface of the piston 31 is separated from the sealing seat 44 located at the base of the piston passage section 41, and the liquid in the suction chamber CI is discharged to the exterior of the compression mechanism sequentially through the liquid entry section 42, the piston passage section 41 and the liquid outlet 43.

As shown in FIG. 3*b*, when the scroll compressor does not need to discharge liquid, the compression chamber including the suction chamber CI is normally filled with gaseous working medium. The working medium is compressed by the series of compression chambers, and the pressure gradually increases from a radial outer compression chamber to a radial inner compression chamber. That is, in the normal operation state of the compressor, the pressure in the compression chamber located closer to the radial outer side is less than that in the compression chamber located closer to the radial inner side. The relatively high pressure gas in the intermediate compression chamber located at the radially inner side of the suction chamber CI enters the pressure control chamber CP through the pressure control passage constituted by the pressure tapping hole 45 and the channel groove, and the like. Although the pressure control passage is provided with the throttling expansion structure, the pressure of the gas entering the pressure control chamber CP is slightly reduced compared to that of the intermediate compression chamber located at the radially inner side of the suction chamber CI, but still higher than the pressure in the suction chamber CI. Therefore, the pressure on the lower end surface of the piston 31 is less than the pressure on the upper end surface of the piston 31, and the piston 31 moves downward to the closed position under the action of the pressure difference, the lower end surface of the piston 31 and the sealing seat 44 located at the base of the piston passage section 41 are fitted with each other and seal the liquid entry section 42, thereby isolating the suction chamber CI from the suction pressure region external to the compression mechanism and allowing the scroll compressor to perform normal compression operation.

Although in the embodiments of the present disclosure, the discharge passage is preferably configured to be communicable with the suction chamber CI to allow the liquid to be discharged from the compression mechanism as quickly as possible, but it can be understood by those skilled in the art that the discharge passage can be configured to be communicable with the intermediate compression chamber located close to the suction chamber CI of multiple intermediate compression chambers. In addition, in the embodiments of the present disclosure, the pressure tapping hole 45 is preferably configured to be communicable with the central compression chamber or the intermediate compression chamber located close to the central compression chamber to ensure that the fluid introduced to the pressure control chamber CP has a high pressure, but it also can be understood by those skilled in the art that, as long as the compression chamber with which the pressure tapping hole 45 is in communication is closer to the radial inner side of the compression mechanism than the compression chamber with which the discharge passage is in communication, that is, as long as the pressure in the compression chamber with which the pressure tapping hole 45 is in communication is higher than that in the compression chamber with which the discharge passage is in communication, the control of the piston can be realized.

Figure 5:
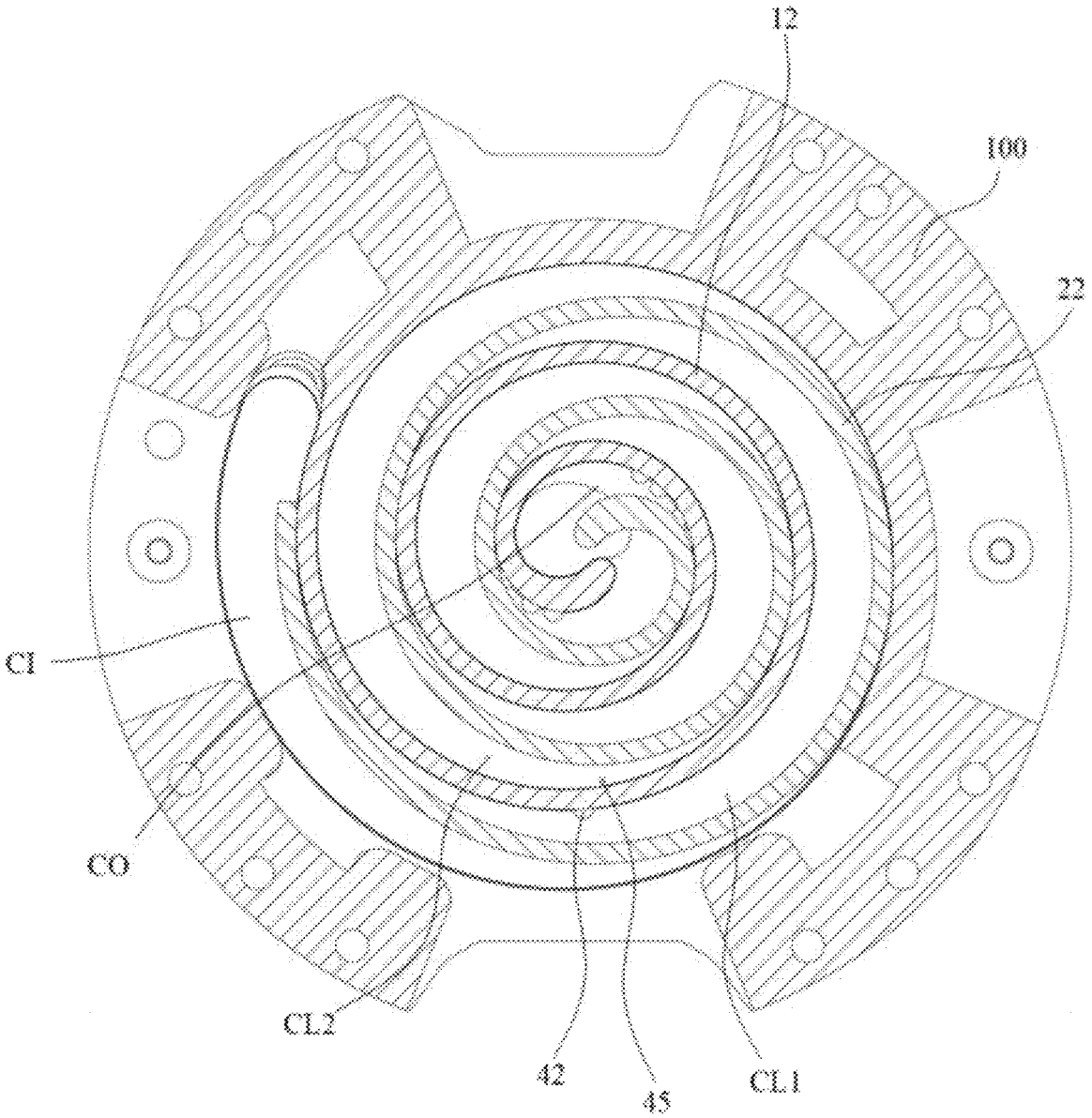
FIG. 5 is a cross-sectional view of the compression mechanism of the scroll compressor according to the first embodiment of the present disclosure.

As shown in FIG. 5, the liquid entry section 42 and the pressure tapping hole 45 are respectively in communication with the first fluid compression chamber (also known as the "discharge fluid compression chamber") CL1 and the second fluid compression chamber CL2 different from each other. The first fluid compression chamber CL1 is closer to the radial outer side of the compression mechanism than the second fluid compression chamber CL2. Here, it should be noted that the "first" and "second" do not represent the order of the fluid compression chamber, but are only used to distinguish different fluid compression chambers. Therefore, it can be ensured that the pressure in the pressure control chamber CP is constantly greater than the pressure in the liquid entry section 42, in the non-liquid strike operating condition, thereby ensuring that the piston 31 is in the closed position and the compressor can operate normally. In the liquid strike operating condition, the discharge passage can provide fluid communication between the first fluid compression chamber CL1 and the suction pressure region external to the compression mechanism, and the liquid in the compression chamber can be discharged to the exterior of the compression mechanism in time without being subjected to or as little as possible being subjected to the pushing and squeezing of the scroll blade, thereby reducing the impact of the liquid on the scroll blade and avoiding the damage to the scroll blade. In the early stage of the start-up of the compressor in which liquid strike easily occurs, it is also conducive to reducing the starting torque of the compressor, reducing the impact load on the motor, ensuring the operating stability and reliability of the compressor, and effectively extending the service life of the motor. In addition, apparently, the discharge control mechanism according to the present disclosure includes a throttling expansion structure provided in the pressure control passage. The throttling expansion structure is configured to expand and vaporize the liquid fluid from the compression mechanism to passively generate a pressure difference. Therefore, the opening and closing of the discharge passage can be controlled without a separate electric/power source, thereby the discharge control mechanism according to the present disclosure having less parts, simple production and low costs. In addition, the discharge control mechanism according to the present disclosure generate the pressure difference by using only the fluid from the compression mechanism, without the need to introduce fluid from the exterior of the compression mechanism, which is simpler in structure and reliable in operation.

In addition, in order to make the liquid in the suction chamber CI to be discharged more quickly through the discharge passage during the discharge, in a case that the piston 31 is in the open position, the side wall of the piston 31 preferably does not cover the liquid outlet 43, thereby increasing the flow area of the discharge passage and allowing the liquid to flow out more smoothly through the liquid outlet 43.

In addition, in order to ensure effective control of the pressure control chamber CP, preferably a sealing member 312, such as an O-ring, is further provided between the piston 31 and the piston passage section 41 and is accommodated in a sealing groove 311 formed on the outer surface of the piston 31, to provide the sealing between the outer surface of the piston 31 and the inner surface of the piston passage section 41. In addition, wherever the piston 31 is located, the sealing member 312 is always located above the liquid outlet 43, so as to ensure that the space above the sealing member 312 is always hermetically isolated from the space below the sealing member 312, and thus the liquid outlet 43 is isolated from the pressure control chamber CP, which avoids the liquid entering the pressure control chamber CP and ensures accurate and fast control by the pressure control chamber CP on the piston 31.

In addition, although the pressure control passage shown in the first embodiment of the present disclosure includes the expansion hole 48, it can be understood by those skilled in the art that the expansion hole 48 may be omitted and the pressure tapping hole 45 may be directly connected to the pressure control chamber CP through the channel groove, as long as the pressure control passage has the throttling expansion structure. In the case that the expansion hole 48 is omitted, the throttling expansion structure may be formed, for example, as described above through the first section 451 and the second section 452 with different flow cross sections of the pressure tapping hole 45, or may be formed, for example, by the flow cross section area of the channel groove being much greater than the flow cross section area of the pressure tapping hole 45. In addition, it can be understood by those skilled in the art that the pressure control passage may include one or more throttling expansion structures, that is, the expansion hole 48 with its flow cross-sectional area being significantly greater than that of the first channel groove 47, the pressure tapping hole 45 with its the flow cross-sectional area being suddenly increased, and the channel groove with its the flow cross-sectional area being suddenly increased than that of the pressure tapping hole 45 may be arranged in the pressure control passage individually or in combination.

In addition, in order to make the discharge control mechanism more compact, space-saving and easier to process, preferably, the pressure tapping hole 45, the expansion hole 48 and the piston passage section 41 are arranged to extend along the axis direction of the compression mechanism and located in different planes (not coplanar) extending along the axis direction of the compression mechanism. The first channel groove 47 and the second channel groove 46 are formed by forming a groove on the upper surface of the discharge mechanism platform 40. For a group of discharge passages, a single cover member may be used to simultaneously cover on the pressure tapping hole 45, the expansion hole 48, the discharge passage, the first channel groove 47 and the second channel groove 46 and form the sealing, thereby allowing the mechanism to have less parts, less space occupation, and simpler production and assembly.

On the other hand, it can be understood by those skilled in the art that the pressure tapping hole 45 may be arranged separately from the discharge passage and that the pressure tapping hole 45 and the piston passage section 41 of the discharge passage may be covered and sealed with multiple cover members to provide a more flexible design of component locations. Even, the pressure tapping hole 45 may be arranged on an radial inner side of the hub portion 14 to introduce the high-pressure gas from the central compression chamber or the exhaust chamber into the pressure control chamber CP. In addition, the pressure tapping hole 45 is not limited to extending along the axis direction of the compression mechanism as shown in FIG. 4, but can be configured as other suitable configurations, such as a bent configuration or an inclined configuration extending inclinedly relative to the horizontal direction in the fixed scroll end plate. As long as the first end of the pressure tapping hole 45 is in communication with the second fluid compression chamber and the second end of the pressure tapping hole 45 is directly or indirectly communicable with the pressure control chamber CP. For example, in a case that the pressure tapping hole is configured as a bending configuration formed by connection of an axial extension section and a transverse extension section, the axial extension section of the pressure tapping hole has a first end in communication with the second fluid compression chamber, and the transverse extension section of the pressure tapping hole is formed in the fixed scroll end plate and has a second end which may be directly connected to the pressure control chamber CP, without providing the cover member to cover and seal the pressure tapping hole. As long as the pressure tapping hole has the throttling expansion structure, it can be ensured that the liquid in the compression chamber is discharged in time to the exterior of the compression mechanism in the discharge operating condition, while ensuring the normal operation of the compressor in a non-liquid strike operating condition.

It can be understood by those skilled in the art that multiple discharge passages and discharge control mechanisms may be provided at multiple positions of the fixed scroll according to the need for discharge. The discharge passages and the discharge control mechanisms may be, as described in the first embodiment of the present disclosure, provided on the radial outer side of the hub portion of the fixed scroll, and may be alternatively provided on the end surface of the hub portion of the fixed scroll. A scroll compressor according to a second embodiment of the present disclosure is described below with reference to FIGS. 6 to 8 in which the discharge passages and the discharge control mechanisms are provided on the end surface of the hub portion 14 of the fixed scroll. In the second embodiment, main components, installation mode and operating principle of the scroll compressor, especially the discharge operation and principle, are similar to the first embodiment of the present disclosure and are therefore not repeated.

Figure 6:
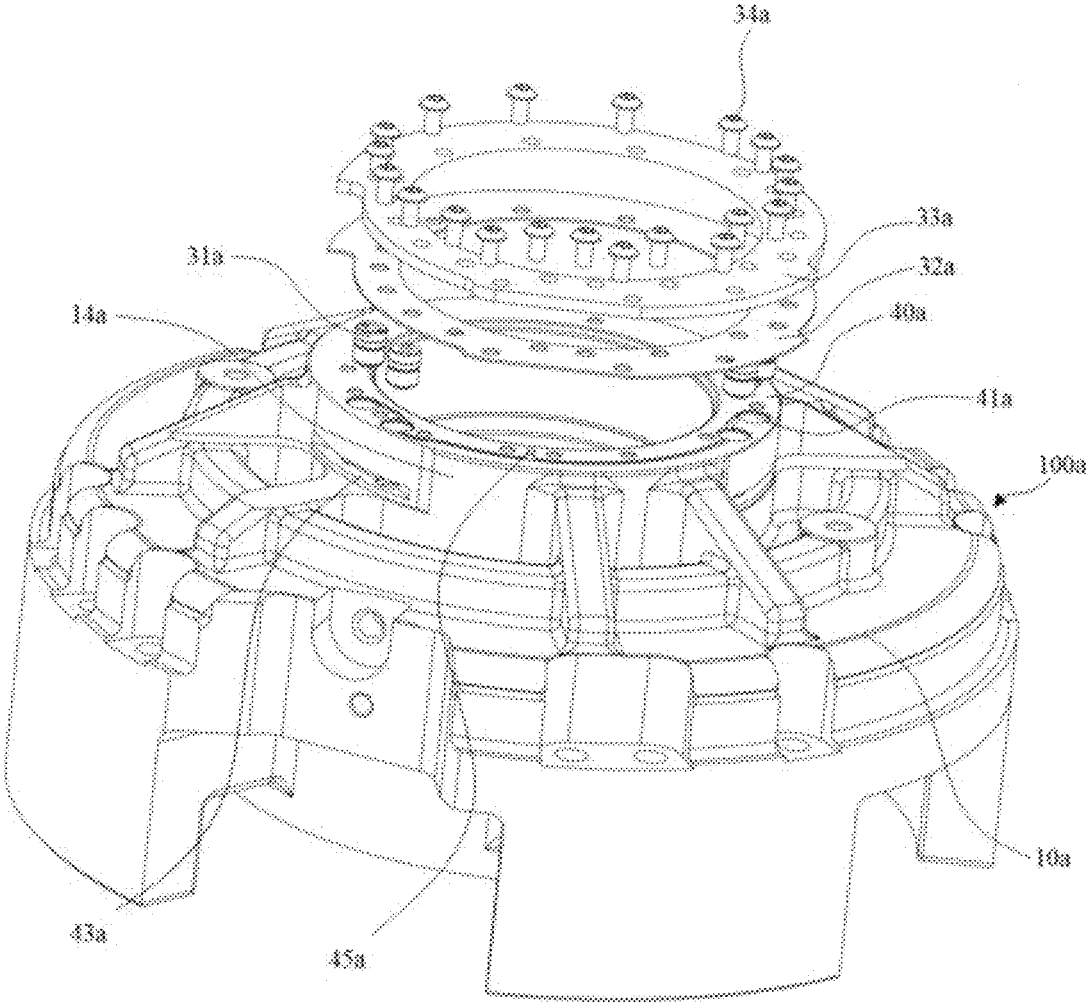
FIG. 6 is an exploded perspective view of a compression mechanism of a scroll compressor according to a second embodiment of the present disclosure, in which an orbiting scroll is not shown.
Figure 8:
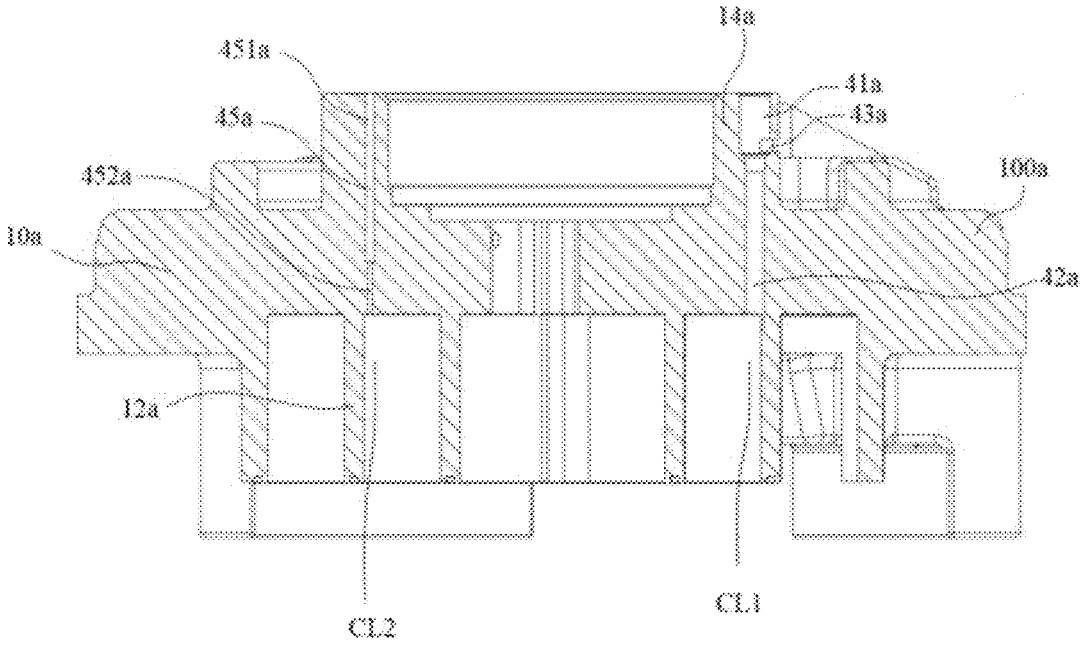
FIG. 8 is a longitudinal sectional view of a fixed scroll of the compression mechanism of the scroll compressor according to the second embodiment of the present disclosure.

As shown in FIG. 6, a discharge mechanism platform 40*a* is formed on the upper end surface of the hub portion 14*a* of the fixed scroll 100*a*. The discharge passage and the discharge control mechanism are formed at the discharge mechanism platform 40*a*. As shown in FIG. 8, the discharge passage is configured to extend from the upper end surface of the hub portion 14*a* through the fixed scroll 100*a* substantially along the axis direction of the compression mechanism, to the first side of the fixed scroll end plate 10*a*. Similar to the first embodiment of the present disclosure, the discharge passage includes a piston passage section 41*a* and a liquid entry section 42*a* connected with each other in the axis direction of the compression mechanism. One end of the liquid entry section 42*a* is in communication with a first fluid compression chamber in a series of compression chambers of the compression mechanism. The side part of the piston passage section 41*a* further has a liquid outlet 43*a* in communication with a suction pressure region external to the compression mechanism. As shown in FIG. 6, the discharge control mechanism mainly includes a piston 31*a*, a cover member, a fixing member 34*a* and a pressure tapping hole 45*a*. The piston 31*a* is accommodated in the piston passage section 41*a* of the discharge passage and is movable between an open position and a closed position along the piston passage section 41*a*. The cover member includes a gasket 32*a* and a cover plate 33*a*, both of which are sequentially mounted and fixed to the discharge mechanism platform 40*a* by a fixing member 34*a* such as a screw and cover on the piston passage section 41*a* of the discharge passage to form sealing, thereby forming a pressure control chamber in a region between the cover member and the piston 31*a* in the piston passage section 41*a*. As shown in FIG. 8, the pressure tapping hole 45*a* is configured to extend from the upper end surface of the hub portion 14*a* substantially along the axial direction of the compression mechanism through the fixed scroll 100*a* to the first side of the fixed scroll end plate 10*a*. The first end of the pressure tapping hole 45*a* is in communication with the second fluid compression chamber located radially inward with respect to the first fluid compression chamber, and the second end, opposite to the first end, of the pressure tapping hole 45 is in communication with the pressure control chamber in the piston passage section 41*a* through the channel groove 47*a*. The channel groove 47*a* is formed by forming a groove on the upper end surface of the hub portion 14*a*. The pressure tapping hole 45 and the channel groove 47*a* together constitute the pressure control passage for guiding the fluid in the second fluid compression chamber to the pressure control chamber CP. Similar to the first embodiment, the pressure control passage is also provided with one or more throttling expansion structures, for example as shown in FIG. 8, the pressure tapping hole 45*a* includes a first section 451*a* having a first end and a second section 452*a* having a second end in the axis direction of the compression mechanism. The first section 451*a* and the second section 452*a* are connected with each other, and a throttling expansion structure having a suddenly increased flow cross-sectional area is formed at a joint of the first section 451*a* and the second section 452*a*.

Figure 7:
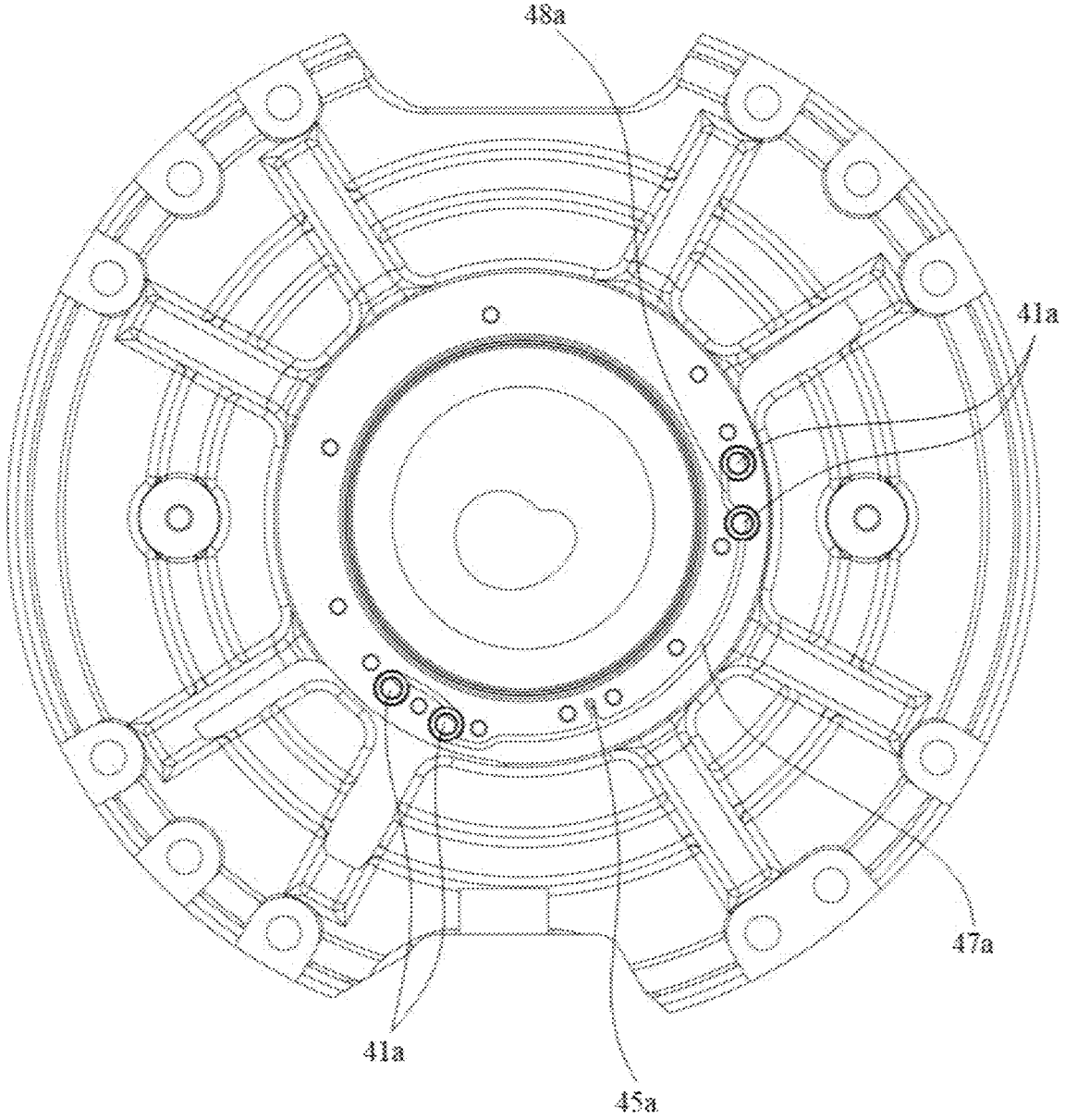
FIG. 7 is a top view of the compression mechanism of the scroll compressor according to the second embodiment of the present disclosure, in which a cover member in a discharge control mechanism is removed.

Preferably, as shown in FIG. 7, two groups of discharge passages arranged substantially symmetrically on two sides of the axis of the fixed scroll may be formed in the fixed scroll 100*a*, so that the compression mechanism is balanced during the discharge. In addition, each group of discharge passages may include one or more discharge passages. A piston 31*a* is provided in the piston passage section 41*a* of each discharge passage. The upper end surface of the hub portion 14*a* of the fixed scroll 100*a* is recessed to form a communication groove 48*a* to allow the pressure control chambers in each group of discharge passages to be in communication with each other. The design with multiple piston passages and multiple pistons further increases the flow area of the discharge passage so that the liquid can be discharged from the compression mechanism as soon as possible.

Preferably, the cover member is configured to have substantially the same shape as the upper end surface of the hub portion 14*a* of the fixed scroll 100*a*. As shown in FIG. 6, the cover member is configured in a single ring-shaped shape. A single ring-shaped cover member can simultaneously cover on the pressure tapping hole 45*a*, the discharge passage and the channel groove 47*a* and the communication groove 48*a* and form the sealing, thereby allowing the mechanism to have less parts, less space occupation, and simpler production and assembly. In addition, only one pressure tapping hole 45*a* may be provided between two groups of discharge passages. Due to the pressure control chambers in all of the piston passage sections 41*a* in each group of discharge passages are in communication with each other through the communication groove 48*a*, and each group of discharge passages is in communication with the pressure tapping hole 45*a* through the channel groove 47*a*, for the whole compression mechanism, only a single pressure tapping hole 45*a* is required to be provided to realize synchronous control of multiple pistons, which is not only simpler in structure, but also achieve quicker discharge and easier processing. Preferably, a single pressure tapping hole 45*a* is arranged at a substantially middle position between the two groups of discharge passages so that fluid from the compression chamber can enter the pressure control chamber in substantially equal volumes.

In addition, in comparison with the first embodiment of the present disclosure, since the discharge passage and the discharge control mechanism are provided at the discharge mechanism platform 40*a* formed by the upper end surface of the hub portion 14*a* of the fixed scroll 100*a* in the second embodiment of the present disclosure, there is no need to process the discharge mechanism platform separately, which is not only more convenient for processing and production, but also more space saving.

In addition, although in the first and second embodiments of the present disclosure, the discharge passage and the discharge control mechanism are provided on the fixed scroll, it can be understood by those skilled in the art that the discharge passage and the discharge control mechanism may alternatively be provided on the orbiting scroll and similar effects can be obtained.

A compression mechanism CM and a scroll compressor according to a third embodiment of the present disclosure are described below with reference to FIGS. 9 and 10. The basic structure and operating principle of the compression mechanism CM and the scroll compressor according to the third embodiment are similar to those of the scroll compressor in the first and second embodiments, and will not be repeated here. It should be noted that, in order to discharge the liquid in the compression mechanism in time and effectively in a specific operating condition, the compression mechanism CM according to the third embodiment of the present disclosure further includes a discharge passage DP and a movable blocking member (such as a piston or valve sheet) 31*b* provided in the discharge passage DP. The discharge passage DP is provided in a fixed scroll end plate 10*b*, and includes a blocking member passage portion PP extending from a first side of the fixed scroll end plate 10*b* to a second side and extending substantially the axial direction, and a liquid discharge portion 43*b* through which the blocking member passage portion PP is in communication with the exterior of the compression mechanism. The blocking member passage portion PP includes a blocking member passage section (piston passage section) 41*b* for accommodating the movable blocking member 31*b* and an liquid entry section 42*b* through which the piston passage section 41*b* is in communication with a first fluid compression chamber CL1. The liquid discharge portion 43*b* is configured to be a discharge passage through which the piston passage section 41*b* is in communication with the exterior of the compression mechanism CM and extending substantially along a transverse direction (the transverse direction herein is perpendicular to the axial direction). The blocking member passage portion PP, in the axial direction, includes a liquid inlet 421*b* located at the first side of the fixed scroll end plate 10*b*and a pressure tapping opening 410*b*, opposite to the liquid inlet 421*b*, located on the second side of the fixed scroll end plate 10*b*. A liquid outlet in communication with the discharge passage is further formed on the side part of the piston passage section 41*b*. As shown in FIG. 9 and FIG. 10, the pressure tapping opening 410*b* is arranged in the back pressure chamber P. That is, in the third embodiment according to the present disclosure, the back pressure chamber P is used as the pressure control chamber of the discharge control mechanism.

Figure 14:
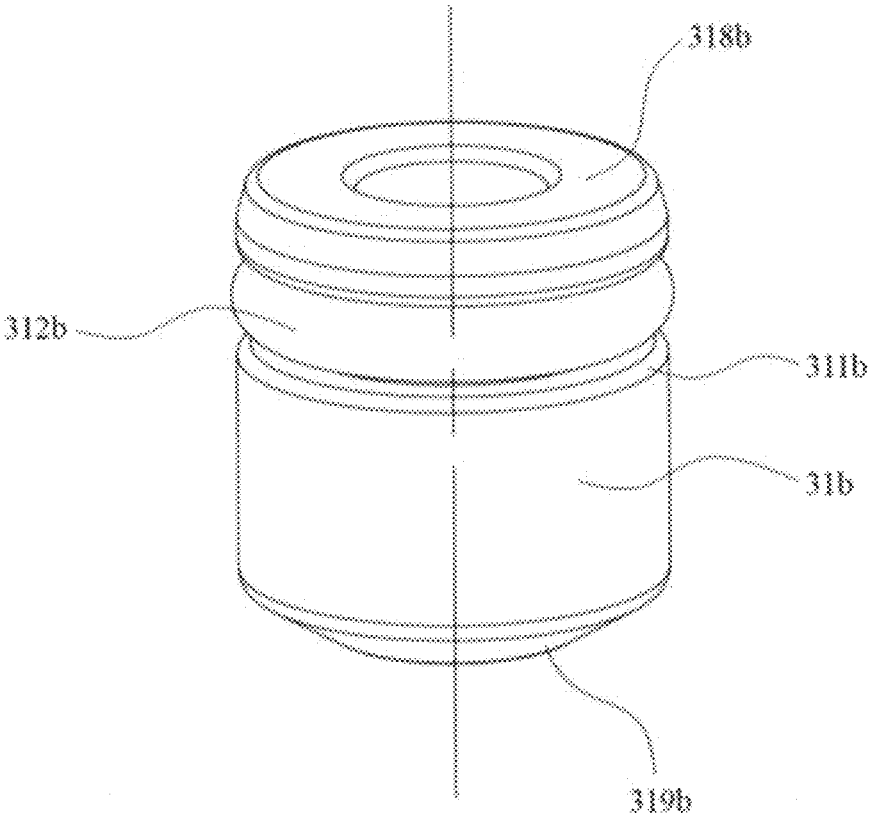
FIG. 14 is a perspective view of a piston of the compression mechanism of the scroll compressor according to the third embodiment of the present disclosure.

A piston 31*b* is provided in the piston passage section 41*b*. The upper end surface (or referred to as "first end surface", the first end 318*b* of the piston 31*b* in the axial direction is used as the first end surface, as shown in FIG. 14) of the piston 31*b* is exposed to the back pressure chamber P through the pressure tapping opening 410*b* of the piston passage section 41*b*. The lower end surface (or referred to as "second end surface", the second end 319*b*, opposite to the first end 318*b*, of the piston 31*b* in the axial direction is used as the second end surface, as shown in FIG. 14) of the piston 31*b* is exposed to one fluid compression chamber (the first fluid compression chamber CL1, as shown in FIG. 11) of a series of compression chambers between the orbiting scroll and the fixed scroll 100*b* through the liquid inlet 421*b*. It should be noted that the "exposed" here means that the upper and lower end surfaces of the piston 31*b* may be respectively in direct contact with the fluid in the back pressure chamber P and the first fluid compression chamber CL1 and thus subjected to the pressure of the fluid in the back pressure chamber P and the first fluid compression chamber CL1, respectively. Therefore, the piston 31*b* is movable between the open position and the closed position in the axial direction in the piston passage section 41*b*, under the action of the pressure difference between its upper end surface and lower end surface. In a case that the pressure in the first fluid compression chamber CL1 is greater than the pressure in the back pressure chamber P, the piston 31*b* moves to the open position and the discharge passage DP provides the fluid communication between the first fluid compression chamber CL1 and the exterior of the compression mechanism CM. In a case that the pressure in the first fluid compression chamber CL1 is less than the pressure in the back pressure chamber P, the piston 31*b* moves to the closed position, and the discharge passage DP does not provide the fluid communication between the first fluid compression chamber CL1 and the exterior of the compression mechanism CM.

Preferably, as shown in FIG. 14, the lower end surface (the second end 319*b*) of the piston 31*b* is configured as a conical, spherical, or planar surface, and a sealing seat 44*b* is formed at a base of the piston passage section 41*b* (a part of the piston passage section 41*b* close to the liquid entry section 42*b*). The sealing seat 44*b* can be fitted with the lower end surface (the second end 319*b*) of the piston 31*b* to form effective sealing against the liquid entry section 42*b*.

The discharge control operating process of a scroll compressor according to a third embodiment of the present disclosure is described below in detail with reference to FIGS. 9, 10, and 11. As shown in FIG. 9, when there is too much liquid in the compression chamber of the scroll compressor to be discharged, due to the incompressibility of the liquid, the compression chambers, including the first fluid compression chamber CL1, are filled with isobaric liquid. The liquid in the first fluid compression chamber CL1 is pushed and squeezed by the scroll blade, and enters the piston passage section 41*b* from the liquid entry section 42*b* and contacts with the second end of the piston 31*b*, exerting greater pressure on the second end of the piston 31*b*. Whereas a medium pressure is built-up in the back pressure chamber P (for example, during the initial stage of start-up of the compressor). Therefore, the pressure exerted by the working fluid (usually gas) in the back pressure chamber P on the first end 318*b* of the piston 31*b* is much less than the liquid pressure exerted on the second end 319*b* of the piston 31*b*. The piston 31*b* moves upward to the open position under the action of the pressure difference. The second end of the piston 31*b* is separated from the sealing seat 44*b* located at the base of the piston passage section 41*b*, and the liquid in the first fluid compression chamber CL1 is discharged to the exterior of the compression mechanism sequentially through the liquid entry section 42*b*, the piston passage section 41*b*, the liquid outlet and the liquid discharge portion 43*b*.

As shown in FIG. 10, when the scroll compressor does not need to discharge liquid, the compression chambers including the first fluid compression chamber CL1 are normally filled with gaseous working medium. The working medium is compressed by the series of compression chambers, and the pressure gradually increases from a radial outer compression chamber to a radial inner compression chamber. That is, in the normal operating state of the compressor, the pressure in the compression chamber located close to the radial center is less than that in the compression chamber away from the radial center (or the pressure in the radial inner compression chamber is less than that in the radial outer compression chamber).

In order to ensure that the scroll compressor avoids unnecessary leakage under the non-liquid strike operating condition, with reference to FIG. 11, the second fluid compression chamber CL2 is closer to the radial center of the compression mechanism CM than the first fluid compression chamber CL1. The back pressure chamber P is in communication with the second fluid compression chamber CL2 located at the radially inner side of the first fluid compression chamber CL1 through the pressure tapping hole 45*b*. Therefore, the back pressure chamber P has a higher pressure than the first fluid compression chamber CL1. As a result, the second end 319*b* of the piston 31*b* is subjected to a pressure less than that of the first end 318*b* of the piston 31*b*, and the piston 31*b* moves downward to the closed position under the action of the pressure difference. The lower end surface of the piston 31*b* and the sealing seat 44*b* located at the base of the piston passage section 41*b* are fitted with each other and seal the liquid entry section 42*b*, thereby isolating the first fluid compression chamber CL1 from the suction pressure region external to the compression mechanism and allowing the scroll compressor to perform a normal compression operation.

With the scroll compressor according to the third embodiment of the present disclosure, it can be ensured that the pressure at the first end 318*b* of the piston 31*b* (which is equal to the pressure in the back pressure chamber P) is constantly greater than the pressure at the second end 319*b* of the piston 31*b* (which is equal to the pressure in the first fluid compression chamber CL1) under the non-liquid strike operating condition, thereby ensuring that the piston 31*b* is in the closed position and the compressor is able to operate normally. In a case of liquid strike, since the discharge passage DP can provide fluid communication between the first fluid compression chamber CL1 and the suction pressure region external to the compressor mechanism, the liquid in the compression chambers can be discharged to the exterior of the compressor mechanism in time without being subjected to, or as little as possible being subjected to the pushing and squeezing of the scroll blade, thereby reducing the impact of the liquid on the scroll blade and avoiding damage to the scroll blade. In the early stage of the start-up of the compressor in which liquid strike easily occurs, it is also conducive to reducing the starting torque of the compressor, reducing the impact load on the motor, ensuring the operating stability and reliability of the compressor, and effectively extending the service life of the motor. In addition, apparently, the discharge control mechanism according to the present disclosure performs pressure control by means of the back pressure chamber P and the pressure tapping hole 45*b*, which can not only passively generate a pressure difference, thereby enabling control of the opening and closing of the discharge passage without the need for a separate electric/power source, but also eliminates the need for providing a separate pressure control chamber and pressure control passage for the piston, and thus the discharge control mechanism according to the present disclosure has less parts, has a simple structure and occupies less space, is easy to produce, has low costs, and is suitable for a wide range of applications.

In an embodiment, the first fluid compression chamber CL1 is a suction chamber among a series of compression chambers or an intermediate compression chamber close to the suction chamber, among multiple intermediate compression chambers (as shown in FIG. 11), so that in a case that the liquid needs to be discharged, the liquid can be discharged from the compression mechanism CM as soon as possible without being subjected to excessive squeezing in the compression mechanism CM, thereby reducing the risk of damage of the compression mechanism CM as much as possible.

In addition, although in the third embodiment of the present disclosure shown in FIGS. 9 and 10, the pressure tapping opening 410*b* of the piston passage section 41*b* is provided directly within the back pressure chamber P so that the first end 318*b* of the piston 31 is exposed to the back pressure chamber P, it will be understood by those skilled in the art that the piston passage section 41*b* may be in communication with the back pressure chamber P through a straight or bent communication passage, as long as the first end 318*b* of the piston 31*b* is subjected to the pressure within the back pressure chamber P. That is, "exposed" herein may cover different designs in which the pressure tapping opening 410*b* of the piston passage section 41*b* is arranged directly in the back pressure chamber P and in which the pressure tapping opening 410*b* of the piston passage section 41*b* is indirectly in communication with the back pressure chamber P through the communication passage.

Figure 13:
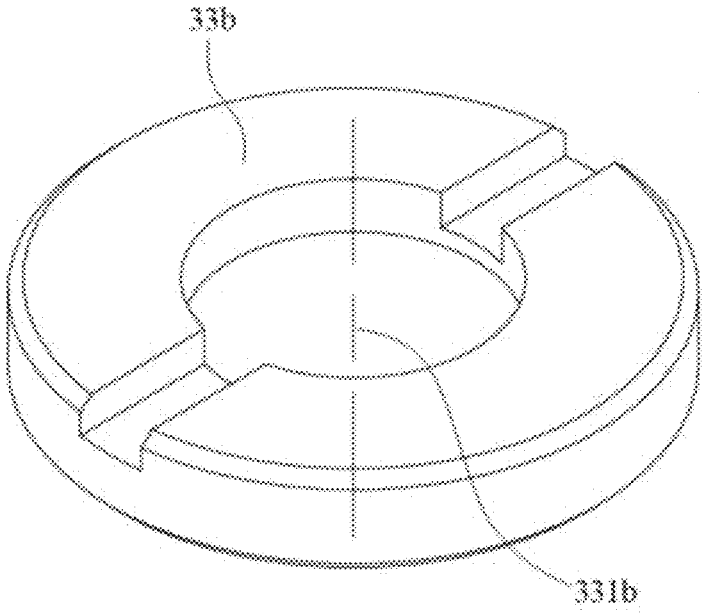
FIG. 13 is a perspective view of a piston end cover of the compression mechanism of the scroll compressor according to the third embodiment of the present disclosure.

In order to prevent the piston 31*b* from moving away from the piston passage section 41*b*, with reference to FIGS. 8 and 9, a piston end cover 33*b* is further provided at the pressure tapping opening 410*b* of the piston passage section 41*b*. The piston end cover 33*b* is fixed to the fixed scroll end plate 10*b* within the back pressure chamber P, and a lower surface of the piston end cover 33*b* may contact with the upper end surface (first end 318*b*) of the piston 31*b* to stop the piston 31*b*, thereby preventing the piston 31*b* from moving from the piston passage section 41*b* into the back pressure chamber P. As shown in FIG. 13, the piston end cover 33*b* is formed with, for example, a centrally located through-hole through which the first end 318*b* of the piston 31*b* is exposed to the back pressure chamber P. In addition, the piston end cover 33*b* may be fixed to the fixed scroll end plate in a suitable manner. For example, a threaded portion is formed on an outer peripheral wall of the piston end cover 33*b*, and the fixed scroll end plate 10*b* at the bottom of the back pressure chamber P has a recess for accommodating the piston end cover 33*b*. A threaded portion meshing with the threaded portion of the piston end cover 33*b* is formed on the inner peripheral surface of the recess, thereby the piston end cover 33*b* being fixed to the fixed scroll end plate 10*b* at the bottom of the back pressure chamber P in the threaded connection. In addition, the sealing seat 44*b* of the piston passage section 41*b* is configured in the form of a flange protruding inward from the inner wall of the piston passage section 41*b*, thereby not only facilitating the formation of sealing with the second end 319*b* of the piston 31*b*, but also preventing the piston 31*b* from moving from the piston passage section 41*b* into the liquid entry section 42*b* and thus into the first fluid compression chamber CL1.

In addition, in order to ensure effective control on the piston 31*b*, as shown in FIG. 14, preferably, a sealing member 312*b*, such as an O-ring, is further provided between the piston 31*b* and the piston passage section 41*b* and is accommodated in a sealing groove 311*b* formed on the outer surface of the piston 31*b*, to provide the sealing between the outer surface of the piston 31*b* and the inner surface of the piston passage section 41*b*. In addition, wherever the piston 31*b* is located, the sealing member 312*b* is always located above the liquid outlet on a side part of the blocking member passage corresponding to the position of the liquid discharge portion, so as to ensure that the space above the sealing member 312*b* is always hermetically isolated from the space below the sealing member 312*b*, and thus the liquid outlet is isolated from the back pressure chamber P, which avoids the liquid entering the back pressure chamber P and avoids the leakage from the back pressure chamber P, thereby ensuring accurate and fast control by the back pressure chamber P on the piston 31*b*.

Figure 12:
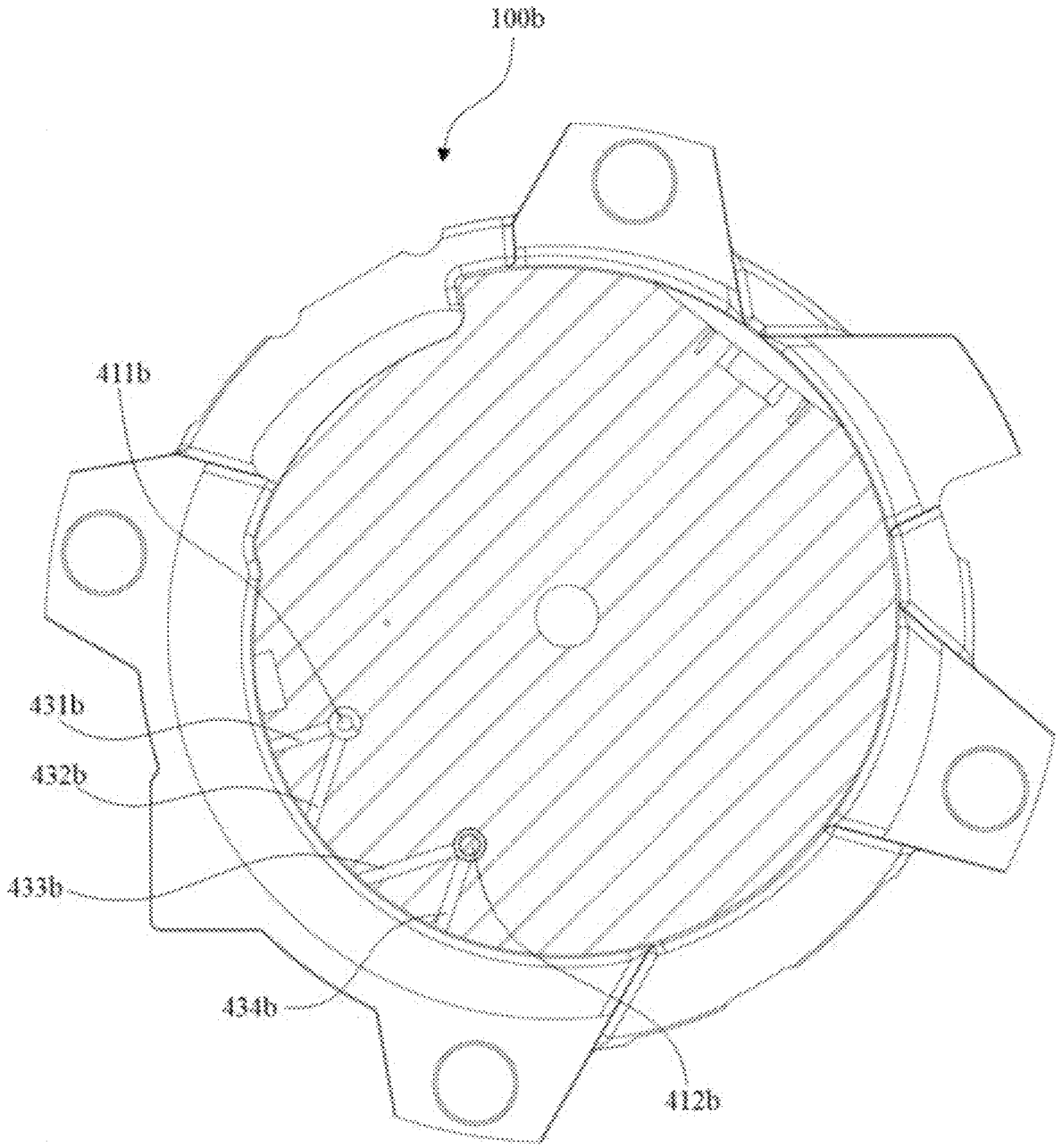
FIG. 12 is another cross-sectional view of the compression mechanism of the scroll compressor according to the third embodiment of the present disclosure.

Preferably, the fixed scroll end plate 10*b* may include two groups of discharge passages DP arranged substantially symmetrically on two sides of the axis of the fixed scroll, so that the compression mechanism is balanced when discharging liquid. Further, preferably, the fixed scroll end plate 10*b* may include two groups of discharge passages arranged at a position close to the suction port CI of the compression mechanism. As shown in FIG. 11, the two groups of discharge passages are exposed to the same compression chamber and arranged substantially adjacent to each other on one side of the axis of the fixed scroll end plate 10*b* so that the liquid is discharged from the compression mechanism as early as possible and as efficiently as possible. Each group of discharge passages may include one or more piston passages provided at a location where the liquid is to be discharged. Each piston passage is provided with a piston, the respective second ends of the pistons may not be exposed to the same compression chamber, but the first ends of all the pistons are exposed to the back pressure chamber, thereby facilitating the discharge of the liquid. Such design is more flexible and easier to process. In addition, each piston passage may include one or more liquid outlets according to specific discharge needs, thereby being connected to a corresponding number of discharge passages through the liquid outlet. For example, as shown in FIG. 12, the discharge passage DP includes a first piston passage 411*b* and a second piston passage 412*b*. The first piston passage 411*b* includes two liquid outlets, and the first discharge passage 431*b* and the second discharge passage 432*b* are in communication with the first piston passage 411*b* through corresponding liquid outlets of the first piston passage 411*b*, respectively, and extend from the corresponding liquid outlet toward the exterior of the compression mechanism along different transverse directions perpendicular to the axial direction. The second piston passage 412*b* includes two liquid outlets, and the third discharge passage 433*b* and the fourth discharge passage 434*b* are in communication with the second piston passage 412*b* through corresponding liquid outlets of the second piston passage 412*b*, respectively, and extend from the corresponding liquid outlet towards the exterior of the compression mechanism along different transverse directions perpendicular to the axial direction. That is, the multiple discharge passages may be in communication with the single piston passage through the corresponding liquid outlets. The design of the multiple discharge passages being connected to the single piston passage further increases the flow area of discharged liquid, allowing the liquid to be discharged from the compression mechanism as quickly as possible.

It can be understood by those skilled in the art that although the liquid discharge portion (the discharge passage) shown in the accompanying drawings has a substantially constant flow area, the liquid discharge portion 42*b* may alternatively be configured to have a flow area that gradually increases in a direction extending from the connected liquid outlet toward the exterior of the compression mechanism, thereby further increasing the flow area of discharged liquid and facilitating the discharge of liquid from the compression mechanism. For example, the liquid discharge portion (the discharge passage) may be configured to have a substantially fan-shaped shape in cross-section perpendicular to the axial direction. In addition, the flow face of the discharge passage may be circular, oblong, rectangular, or the like.

In an embodiment, the individual blocking member passage section may be configured in such a way that a part of the liquid entry section is overlapped with the fixed scroll blade 12*b*, when viewed in the axial direction of the compression mechanism. With this configuration, on the one hand, the flow area of the liquid entry section can be further increased, allowing the liquid to enter the discharge passage more quickly, and on the other hand, the location design of the discharge passage can be facilitated while ensuring the functionality of the liquid inlet.

In addition, it can be understood by those skilled in the art that the present disclosure is not limited to the opening and closing of the discharge passage by a piston, but rather any movable blocking member that allows to be controlled by a pressure difference, for example, a valve sheet that can be opened and closed under the action of the pressure difference, may be used.

Furthermore, although in the third embodiment of the present disclosure, the discharge passage, the piston, and the pressure tapping hole are provided on the fixed scroll and the back pressure chamber is provided on the second side of the fixed scroll, it can be understood by those skilled in the art that the discharge passage, the piston, and the pressure tapping hole may alternatively be provided on the orbiting scroll and the back pressure chamber may be provided on a side of the orbiting scroll. With the above arrangement, a similar effect as the arrangement of the discharge passage located on the fixed scroll in the embodiment of the present disclosure can be achieved.

A compression mechanism and a scroll compressor according to a fourth embodiment of the present disclosure are described below with reference to FIGS. 15 to 19*b*. The basic structure and operating principle of the compression mechanism CM and the scroll compressor according to the fourth embodiment are similar to those of the scroll compressor in the first and second embodiments, and will not be repeated herein. It should be particularly noted that, in order to discharge the liquid from the compression mechanism, a discharge passage DP is formed in a fixed scroll end plate 10*c*. As shown in FIGS. 17*a* and 17*b*, the discharge passage is provided in the fixed scroll 100*c* and is configured to include a blocking member passage portion PP that extends through the fixed scroll 100*c* substantially along the axis direction of the compression mechanism CM, and a liquid discharge portion 43*c* through which the blocking member passage portion PP is in communication with the exterior of the compression mechanism. The blocking member passage portion PP includes a blocking member passage section 41*c* for accommodating the movable blocking member 31*c* and a liquid entry section 42*c* through which the blocking member passage section 41*c* is in communication with the first fluid compression chamber CL1. The blocking member passage portion PP is configured to extend from a second side of the fixed scroll end plate 10*c* to a first side. In order to increase the flow area to allow the liquid to be discharged more smoothly, the liquid discharge portion 43*c* may preferably be configured as an elongated groove extending from a liquid outlet at the side part of the blocking member passage section 41*c* away from the blocking member passage section 41*c* along a direction tangent to a side wall of the blocking member passage section 41*c* (with reference to FIG. 15), and the second side surface of the fixed scroll end plate 10*c* is recessed downward and forms a discharge pool 19*c* that is configured to be in communication with the liquid discharge portion 43*c* to facilitate the liquid to flow out. In addition, preferably, the blocking member passage portion PP may be configured in such a way that a part of the liquid entry section 42*b* is overlapped with the fixed scroll blade 12*c*, when viewed in the axial direction of the compression mechanism. With this configuration, on the one hand, the flow area of the liquid entry section can be further increased to allow the liquid to enter the discharge passage more quickly, and on the other hand, the location design of the blocking member passage portion PP can be facilitated while ensuring the functionality of the liquid entry section.

The compression mechanism further includes a discharge control mechanism DC located substantially on the second side of the fixed scroll end plate 10*b*. In a fourth embodiment of the present disclosure, the pressure control mechanism actively generates a pressure difference. Specifically, the discharge control mechanism mainly includes a controller (not shown in the figures), a solenoid valve 80*c*, a movable blocking member (a piston) 31*c*, a cover member, and a fixing member 34*c*. The piston 31*c* is provided within a blocking member passage section (a piston passage section) 41*c* and is movable, along the piston passage section 41*c*, between an open position and a closed position. Preferably, the lower end surface of the piston 31*c* is configured as a conical, spherical or planar surface, and a sealing seat 44*c* is formed at a base of the piston passage section 41*c*. The lower end surface of the piston 31*c* is capable of being fitted with the sealing seat of the piston passage section 41*c* to form the sealing against the liquid entry section 42*c*.

The cover member includes a gasket 32*c* and a cover plate 33*c*. By inserting the fixing member 34*c*, such as a screw, sequentially through mounting holes on the cover plate 33*c* and on the gasket 32*c* and into a mounting hole on the fixed scroll end plate 10*c*, the gasket 32*c* and the cover plate 33*c* are successively mounted and fixed to the surface of the second side of the fixed scroll end plate 10*b* and cover on the piston passage section 41*c* to form sealing, thereby a pressure control chamber CP being formed in a region between the cover member and the piston 31*c* in the piston passage section 41*c*. By regulating the pressure in the pressure control chamber CP with the solenoid valve 30 to control the pressure difference between positions above and below the piston, the piston 31*c* can be moved to the open position or the closed position according to needs.

Figure 18:
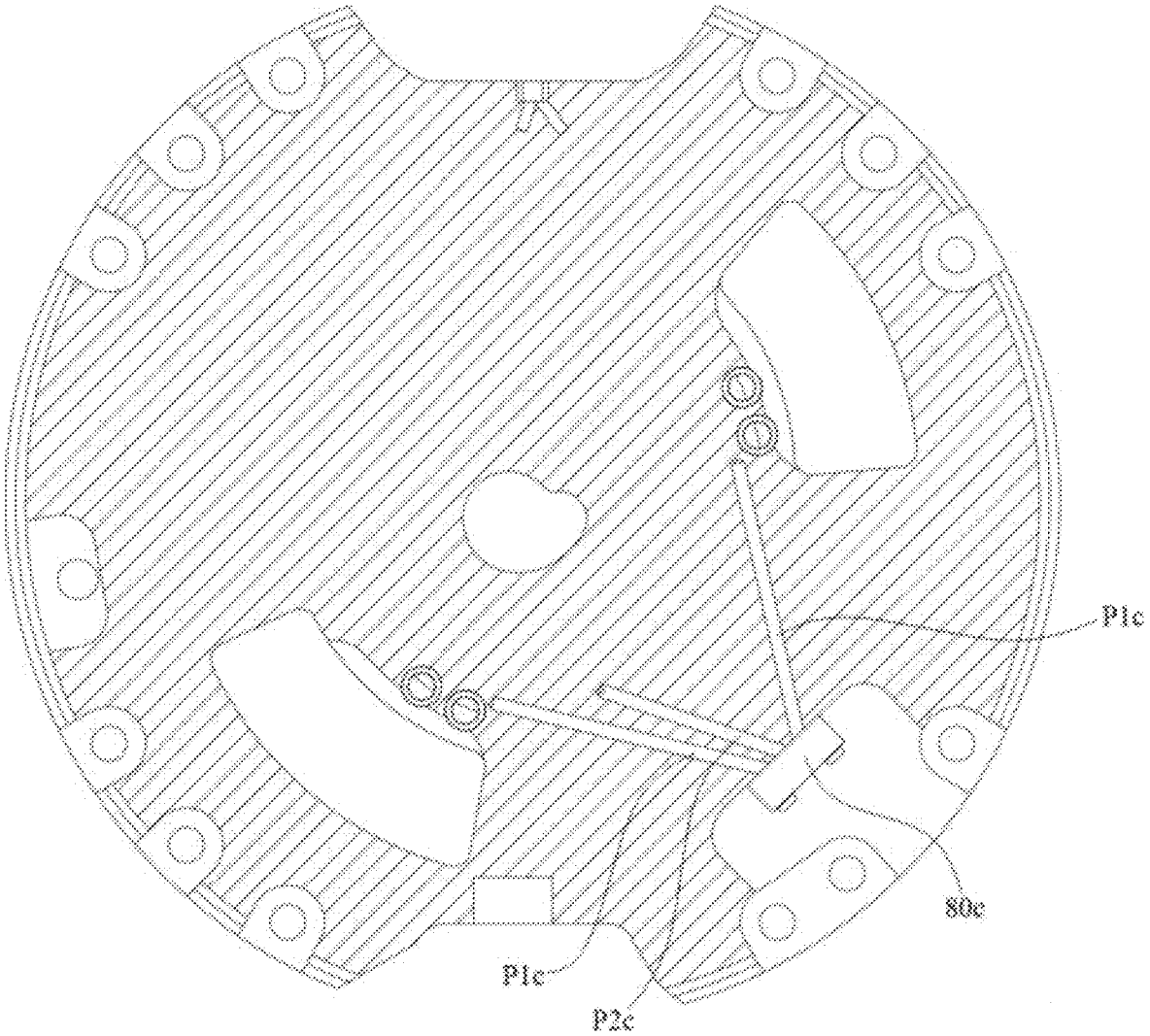
FIG. 18 is a cross-sectional view of a fixed scroll of the compression mechanism of the scroll compressor according to the fourth embodiment of the present disclosure, showing a solenoid valve and a pressure control passage.

The solenoid valve 80*c* is provided in an accommodating recess 18*c* formed on the second side of the fixed scroll end plate 10*c*, and the solenoid valve 80*c* regulates the pressure within the pressure control chamber CP by means of the pressure control passage formed in the fixed scroll end plate 10*c*. Specifically, as shown in FIG. 18, the pressure control passage includes a first pressure control passage P1*c* and a second pressure control passage P2*c* extending substantially in a direction transverse to the axis of the compression mechanism. A first end of the first pressure control passage P1*c* is connected to the solenoid valve 80*c*, and a second end opposite to the first end is in communication with the pressure control chamber CP. The first end of the second pressure control passage P2*c* is connected to the solenoid valve 80*c*, and the second end opposite to the first end is in communication with a central compression chamber CO or at least one intermediate compression chamber located close to the central compression chamber CO.

Figure 19A:
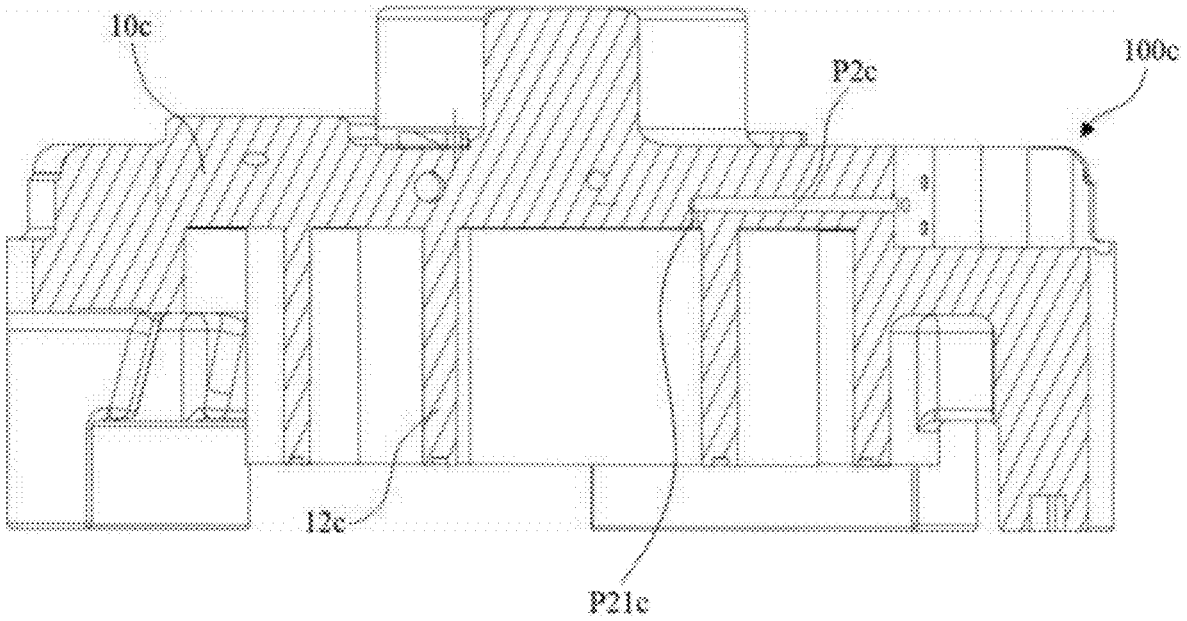
FIGS. 19*a* and 19*b* are longitudinal sectional views in the other sections of the compression mechanism of the scroll compressor according to the fourth embodiment of the present disclosure, showing the pressure control passage.
Figure 19B:
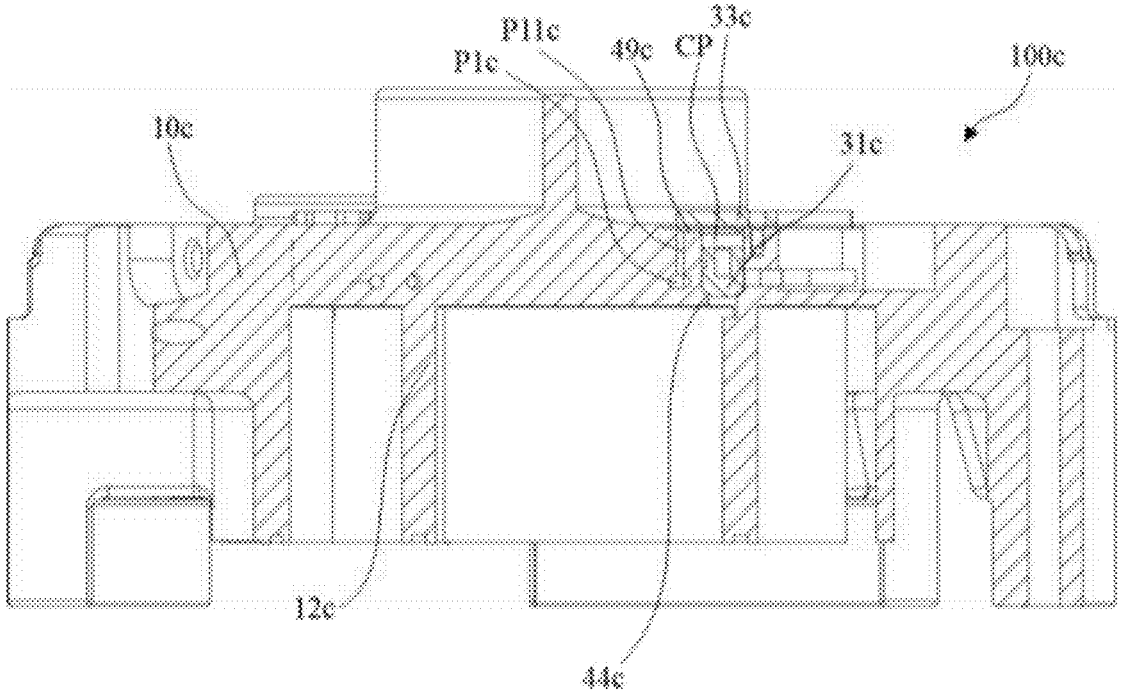

More specifically, as shown in FIG. 19*a*, a second communication vertical hole P21*c* extending substantially along the axial direction of the compression mechanism to the central compression chamber CO or the at least one intermediate compression chamber located close to the central compression chamber CO is further formed at the second end of the second pressure control passage P2*c* of the fixed scroll end plate 10*c*. The second pressure control passage P2*c* is in communication with the central compression chamber CO or the at least one intermediate compression chamber located close to the central compression chamber CO through the second communication vertical hole P21*c*. As shown in FIG. 19*b*, a first communication vertical hole P11*c* extending substantially along the axial direction of the compression mechanism is further formed at the second end of the first pressure control passage P1*c* of the fixed scroll end plate 10*c*. In addition, referring to FIG. 16, a side groove 49*c* extending outward from the piston passage section 41*c* along a direction transverse to the axial direction of the compression mechanism is further formed at the second side of the fixed scroll end plate 10*c*. The side groove 49*c* may be formed by forming a groove on the surface of the second side of the fixed scroll end plate 10*c*, and the side groove 19*c* and the piston passage section 41*c* are covered by the cover member. The first pressure control passage P1*c* is connected to the side groove 49*c* via the first communication vertical hole P11, and thus is in communication with the pressure control chamber CP.

The operating principle of the discharge control mechanism of the scroll compressor is described below with reference to FIGS. 17*a* and 17*b*. The controller is configured to control the solenoid valve 80*c* and thus control the piston 31*c* provided in the discharge passage. As shown in FIG. 17*a*, when there is excessive liquid in the compression chamber of the scroll compressor and there is a need to discharge the liquid (in the liquid-carrying operating condition), the controller sets the solenoid valve 80*c* to a first state (i.e., the solenoid valve 80*c* is energized). In the first state, the solenoid valve 80*c* communicates the first pressure control passage P1*c* with the suction pressure region external to the compression mechanism, thereby the pressure control chamber CP being in communication with the suction pressure region through the first pressure control passage P1*c* to obtain a pressure approximately equal to the suction pressure region. In other words, the upper end surface of the piston 31*c* is subjected to a gas pressure exerted by the pressure control chamber CP that is approximately equal to the pressure in the suction pressure region. The liquid in the suction chamber CI is pushed and squeezed by the scroll blade, contacts with the lower end surface of the piston 31*c* through the liquid entry section, and exerts a thrust force on the lower end surface of the piston 31*c* that is greater than the pressure in the suction pressure region. As a result, the lower end surface of the piston 31*c* is subjected to a thrust force greater than the pressure on the upper end surface of the piston 31*c*, the piston 31*c* moves upward to the open position under the action of the pressure difference, the lower end surface of the piston 31*c* is separated from the sealing seat located at the base of the piston passage section 41*c*, and the liquid in the suction chamber CI is discharged to the exterior of the compression mechanism sequentially through the liquid entry section 42*c*, the piston passage section 41*c*, the liquid outlet, and the liquid discharge portion 43*c*.

As shown in FIG. 17*b*, when the scroll compressor does not need to discharge (in a non-liquid-carrying operating condition), the controller sets the solenoid valve 80*c* to a second state (i.e., the solenoid valve 80*c* is de-energized). In the second state, the solenoid valve 80*c* communicates the first pressure control passage P1*c* with the second pressure control passage P2*c*, thereby the pressure control chamber CP being in communication with the central compression chamber CO or an intermediate compression chamber located close to the central compression chamber CO through the first pressure control passage P1*c* and the second pressure control passage P2*c*, and thus obtaining a high pressure close to the exhaust pressure. In other words, the upper end surface of the piston 31*c* is subjected to a high-pressure gas pressure exerted by the pressure control chamber CP which is approximate to the exhaust pressure. The lower end surface of the piston 31*c* is subjected to a low-pressure gas pressure in the suction chamber CI. Therefore, the pressure on the lower end surface of the piston 31*c* is less than the pressure on the upper end surface of the piston 31*c*, the piston 31*c* moves downward to the closed position under the action of the pressure difference, and the lower end surface of the piston 31*c* is fitted with the sealing seat located at the base of the piston passage section 41*c* and seals the liquid entry section 42*c*, thereby isolating the suction chamber CI from the suction pressure region external to the compression mechanism, and allowing the scroll compressor to perform a normal compression operation.

Although in embodiments of the present disclosure, the discharge passage is configured to be communicable with the suction chamber CI, it can be understood by those skilled in the art that the discharge passage may also be configured to be communicable with an intermediate compression chamber, located close to the suction chamber CI, of the multiple intermediate compression chambers. Alternatively, the discharge passage may be configured to include a first discharge passage communicable with the suction chamber CI and a second discharge passage communicable with an intermediate compression chamber, located close to the suction chamber CI, of the multiple intermediate compression chambers. As the discharge passage can selectively provide fluid communication between the suction chamber CI and the suction pressure region external to the compression mechanism and/or between at least one intermediate compression chamber located close to the suction chamber CI and the suction pressure region external to the compression mechanism, the liquid within the compression chamber can be discharged in time to the exterior of the compression mechanism without being subjected to, or as little as possible being subjected to the pushing and squeezing by the scroll blade, thereby reducing the impact of the liquid on the scroll blade and avoiding the damage to the scroll blade.

In order to allow the liquid in the suction chamber CI to be discharged through the discharge passage more quickly when discharging, it is preferred that the sidewall of the piston 31*c* do not cover the liquid outlet when the piston 31*c* is in the open position, thereby increasing the flow area of the discharge passage and allowing the liquid to flow out more smoothly through the liquid outlet.

Furthermore, preferably, in order to ensure effective control of the pressure control chamber CP, a sealing member 311*c*, such as an O-ring, is further provided between the piston 31*d* and the piston passage section 41*d* and is accommodated in a sealing groove 312*c* formed on the outer surface of the piston 31*c*, to provide the sealing between the outer surface of the piston 31*c* and the inner surface of the piston passage section 41*c*. In addition, wherever the piston 31*c* is located, the sealing member 311*c* is always located above the liquid outlet, so as to ensure that the space above the sealing member 311*c* is always hermetically isolated from the space below the sealing member, and thus the liquid outlet is isolated from the pressure control chamber CP, which avoids the liquid entering the pressure control chamber CP, thereby ensuring accurate and fast control by the pressure control chamber CP on the piston 31*c*.

Figure 15:
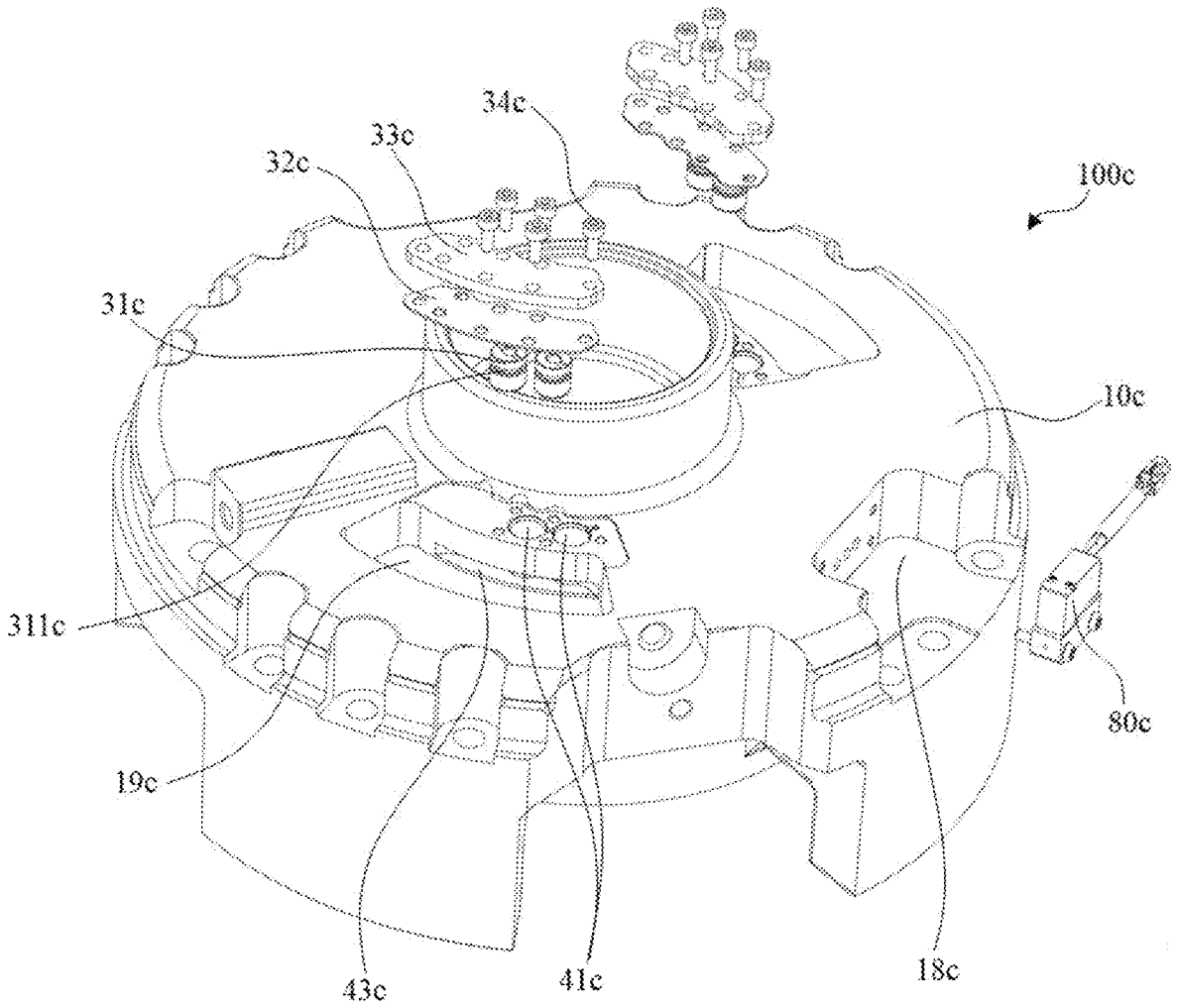
FIG. 15 is an exploded perspective view of a compression mechanism of a scroll compressor according to a fourth embodiment of the present disclosure, in which an orbiting scroll is not shown.
Figure 16:
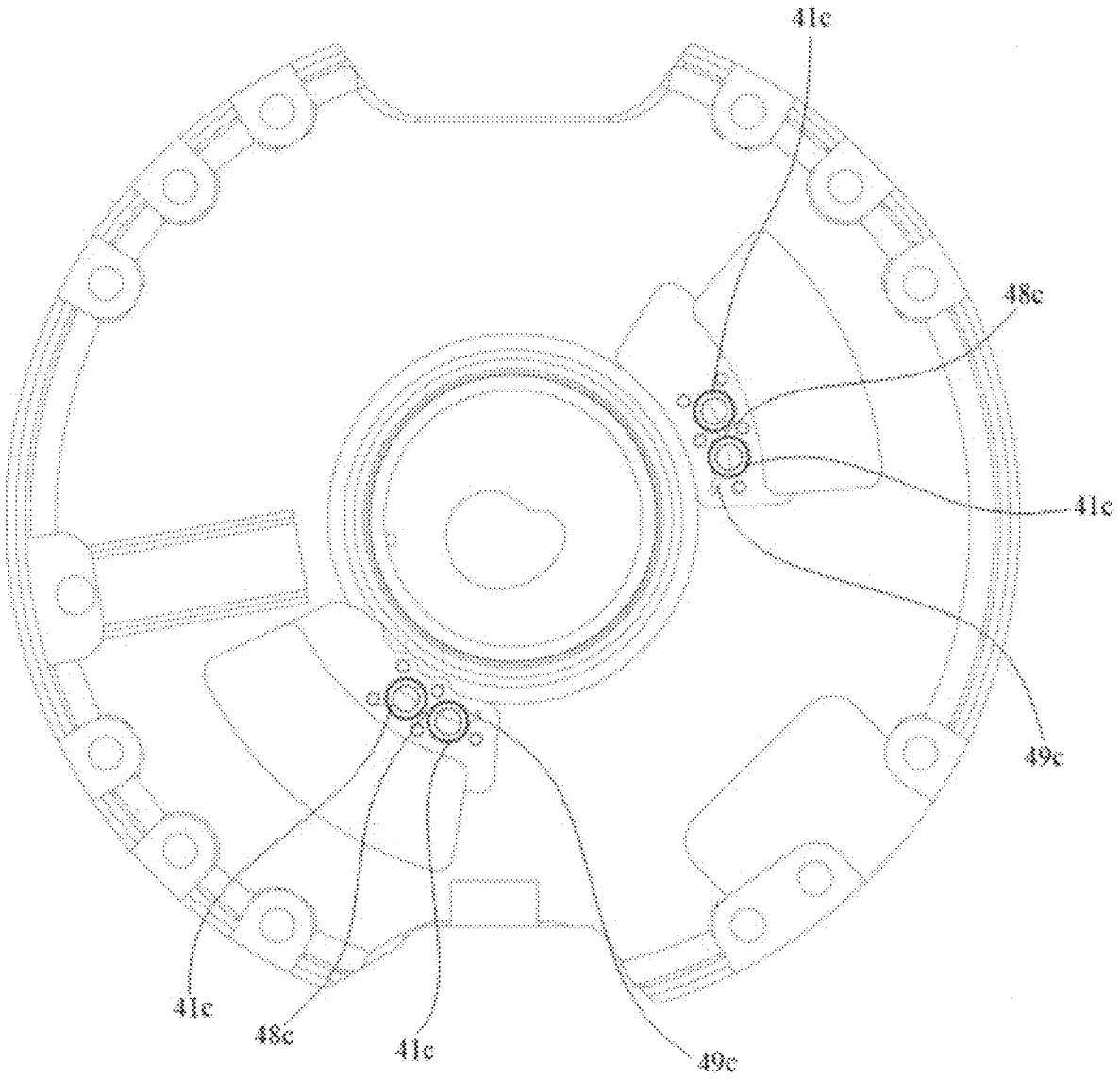
FIG. 16 is a top view of the compression mechanism of the scroll compressor according to the fourth embodiment of the present disclosure, showing a discharge passage and a piston.
Figure 17A:
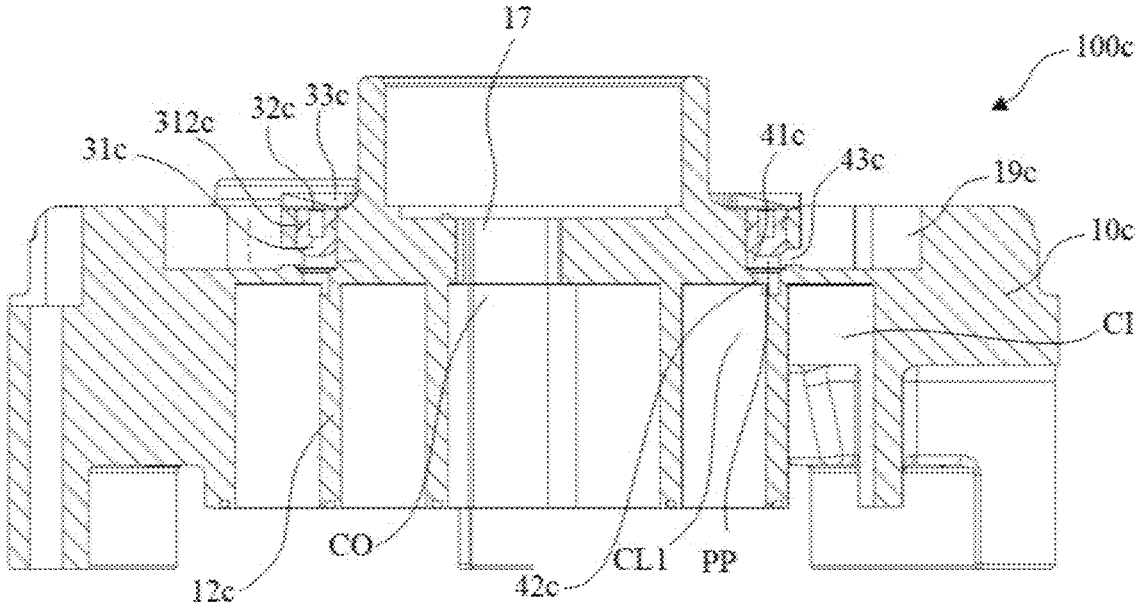
FIG. 17*a* and FIG. 17*b* are longitudinal sectional views of the compression mechanism of the scroll compressor in a discharging state and in a non-discharging state according to the fourth embodiment of the present disclosure, respectively, in which an orbiting scroll is not shown.
Figure 17B:
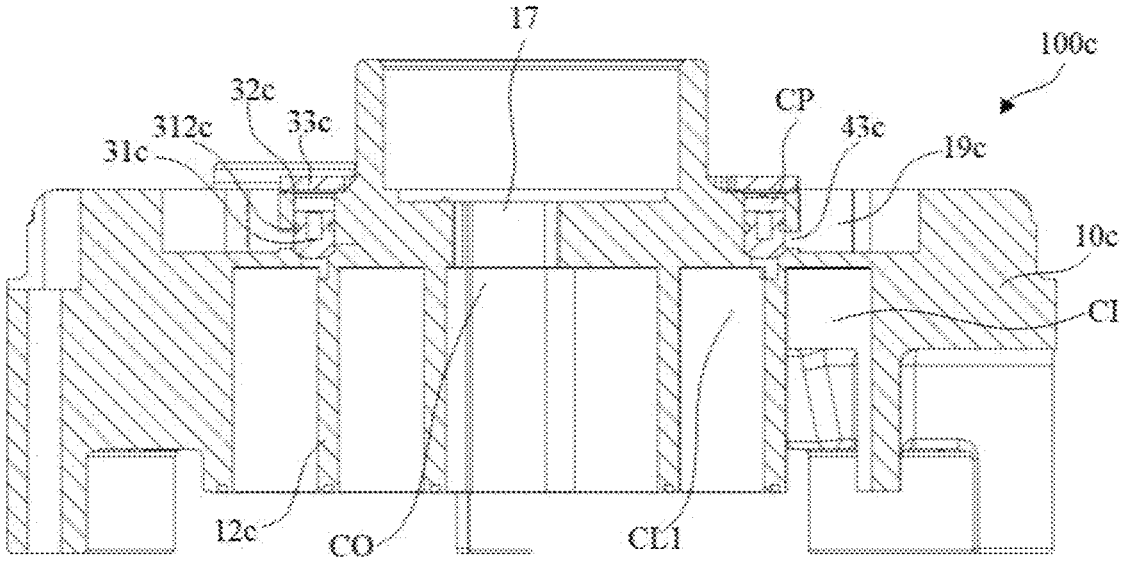

It can be understood by those skilled in the art that, referring to FIG. 16, two groups of discharge passages arranged substantially symmetrically on two sides of the central axis of the compression mechanism may be formed in the fixed scroll end plate 10*c*, so that the compression mechanism is balanced when discharging liquid. In addition, at least one group of discharge passages may include one or more piston passage sections 41*c* (e.g., as shown in FIG. 15, each group of discharge passages includes two piston passage sections 41*c*). Each piston passage section 41*c* is provided with a piston 31*c*. The piston passage sections 41*c* in the group of discharge passages are communicated with each other by a liquid discharge portion in the form of a single elongated groove. Further, the second side surface of the fixed scroll end plate 10*c* is recessed downward to form a communication groove 48*c* to allow the pressure control chambers CP within the piston passage sections 41*c* in each group of discharge passages to be in communication with each other. The cover member may be configured as multiple cover members covering each of the piston passage sections 41*c* in each group of discharge passages and the communication groove 48*c*, respectively, or may be configured as a single cover member covering all of the piston passage sections 41*c* in a group of discharge passages and the communication groove 48*c*. Since the pressure control chambers CP in all of the piston passage sections 41*c* in each group of discharge passages are in communication with each other, only one side groove 49*c* and a corresponding first pressure control passage P1*c* need to be provided for each group of discharge passages. Only one second pressure control passage P2*c* and one solenoid valve 80*c* need to be provided for the entire compression mechanism, which allows synchronous control of multiple pistons. The design of the multiple piston passage sections and the multiple pistons further increases the flow area of the discharge passage, allowing the liquid to be discharged from the compression mechanism as quickly as possible.

It is known to those skilled in the art, particularly for large-displacement scroll compressors, that the liquid strike operating condition typically occurs during the start-up of the compressor. Accordingly, a discharge control method for a scroll compressor is further provided according to the present disclosure to efficiently discharge liquid from the compression chamber during start-up of the compressor to avoid damage of liquid strike to the compressor during the start-up.

Specifically, firstly, the solenoid valve 80*c* is switched to a first state (the solenoid valve 80*c* is energized) at the start-up of the scroll compressor, at which time the first pressure control passage P1*c* is in communication with the suction pressure region external to the compression mechanism, and the piston 31*c* moves upward to the open position. Subsequently, the solenoid valve is kept in the first state for a predetermined time, and the liquid in the suction chamber CI is discharged to the suction pressure region external to the compression mechanism through the discharge passage. The predetermined time is a start-up time set according to the model of the compressor, for example, the predetermined time is set to be 3 to 5 minutes. After the solenoid valve is kept in the first state for the predetermined time, the solenoid valve 80*c* is switched to the second state (the solenoid valve 80*c* is de-energized), at which time the first pressure control passage P1*c* is communicated with the second pressure control passage P2*c*, the piston 31*c* moves downward to the closed position, and the discharge passage no longer discharges the liquid, and the compressor is able to operate normally.

In order to discharge liquid more timely and accurately, another discharge control method for a scroll compressor is further provided according to the present disclosure. The scroll compressor further includes a discharge detection mechanism, which detects at a predetermined time interval or continuously. In response to a detection that the scroll compressor is in a liquid-carrying operating condition, the liquid discharge is performed. The discharge detection mechanism performs the detection, for example, by determining that the compressor is in the liquid-carrying operating condition in response to a detection that a current of the motor has become high and exceeds a threshold value, or a detection that a temperature of the compression mechanism (e.g., a temperature of the central compression chamber CO) has become high and exceeds a threshold value.

Specifically, in a case that the discharge detection mechanism detects that the scroll compressor is in the liquid-carrying operating condition, the controller switches the solenoid valve to the first state and maintains the solenoid valve in the first state. In the first state, the first pressure control passage P1*c* is in communication with the suction pressure region external to the compression mechanism, the piston 31*c* moves upward to the open position, and the liquid in the suction chamber CI is discharged to the suction pressure region external to the compression mechanism through the discharge passage. In a case that the discharge detection mechanism detects that the scroll compressor is in the non-liquid-carrying operating condition, the solenoid valve 80*c* is switched to the second state. In the second state, the first pressure control passage P1*c* is in communication with the second pressure control passage P2*c*, the piston 31*c* moves downward to the closed position, and the liquid is no longer discharged by the discharge passage, and the compressor is able to work normally.

With the discharge control method according to the present disclosure, the discharge passage is able to discharge liquid efficiently depending on needs, which is particularly conducive to reducing the starting torque of the compressor, reducing the impact load on a motor, ensuring the operation stability and reliability of the compressor, and effectively extending the service life of the motor.

Furthermore, although in the embodiments of the present disclosure, the discharge passage and the discharge control mechanism are provided in the fixed scroll, it can be understood by those skilled in the art that the discharge passage and the discharge control mechanism can alternatively be provided in the orbiting scroll and similar effects can be obtained.

Although the present disclosure has been described with reference to exemplary embodiments, it should be understood that the present disclosure is not limited to the specific embodiments described and illustrated in detail herein, and without departing from the scope limited by the claims, various changes can be made by those skilled in the art to the exemplary embodiments. It should also be understood that features of the various embodiments may be combined with each other or may be omitted, provided that the technical solutions are not contradictory.

The invention claimed is:

1. A scroll compressor, comprising:

a housing, a suction pressure region and an exhaust pressure region being defined in the internal space of the housing; and a compression mechanism provided in the housing, the compression mechanism comprising:

a scroll component, comprising an orbiting scroll and a fixed scroll meshing with each other, the scroll component comprising a scroll end plate and a scroll blade formed on a side of the scroll end plate, wherein the scroll end plate comprises an orbiting scroll end plate and a fixed scroll end plate, and the scroll blade comprises an orbiting scroll blade formed on a side of the orbiting scroll end plate and a fixed scroll blade formed on a side of the fixed scroll end plate;

wherein the orbiting scroll blade and the fixed scroll blade mesh with each other to form a series of compression chambers between the orbiting scroll and the fixed scroll, wherein the scroll component is configured to make a fluid to enter the compression mechanism from the suction pressure region and to pass through the series of compression chambers for compressing, and to be exhausted from an exhaust port at a center of the fixed scroll end plate to the exhaust pressure region, wherein the series of compression chambers comprise a central compression chamber in communication with the exhaust port and a fluid compression chamber located at a radially outer side of the central compression chamber;

wherein the compression mechanism is provided with a discharge passage and a discharge control mechanism, the discharge control mechanism allows the discharge passage to selectively provide fluid communication between a discharge fluid compression chamber of the fluid compression chambers and the suction pressure region external to the compression mechanism;

wherein the discharge control mechanism is configured to provide a pressure difference;

wherein the discharge control mechanism further comprises a movable blocking member, which is provided in the discharge passage and is movable under the action of the pressure difference between an open position at which the fluid communication is provided and a closed position at which the fluid communication is not provided; and wherein the discharge passage is provided in the scroll component and is configured to comprise a blocking member passage portion extending through the scroll component substantially along an axis direction of the compression mechanism, and a liquid discharge portion through which the blocking member passage portion is in communication with the exterior of the compression mechanism, wherein the blocking member passage portion comprises a blocking member passage section for accommodating the movable blocking member and a liquid entry section through which the blocking member passage section is in communication with the discharge fluid compression chamber.

2. The scroll compressor according to claim 1, wherein the discharge fluid compression chamber is a suction chamber of the fluid compression chambers or an intermediate compression chamber located close to the suction chamber of the fluid compression chambers.

3. The scroll compressor according to claim 1, wherein the discharge control mechanism is configured to generate the pressure difference by only using a fluid from the compression mechanism.

4. The scroll compressor according to claim 1, wherein the discharge control mechanism further comprises a cover member configured to cover and seal the blocking member passage section, so that a pressure control chamber is formed in a region between the cover member and the movable blocking member in the blocking member passage section.

5. The scroll compressor according to claim 4, wherein the discharge control mechanism is configured to passively generate the pressure difference; and wherein the discharge control mechanism is provided with a throttling expansion structure, configured to expand and vaporize a liquid fluid from the compression mechanism to passively generate the pressure difference.

6. The scroll compressor according to claim 5, wherein the discharge control mechanism further comprises a pressure control passage provided in the scroll component, one end of the pressure control passage is in communication with a second fluid compression chamber of the fluid compression chambers, and the other end of the pressure control passage is in communication with the pressure control chamber, the discharge fluid compression chamber is closer to a radially outer side of the compression mechanism than the second fluid compression chamber, and the throttling expansion structure is provided in the pressure control passage.

7. The scroll compressor according to claim 6, wherein the pressure control passage comprises a pressure tapping hole extending substantially along the axis direction of the compression mechanism, and wherein:

in the axis direction of the compression mechanism, the pressure tapping hole comprises a first section connected to the second fluid compression chamber and a second section connected to the first section, a flow cross-sectional area of the first section is less than a flow cross-sectional area of the second section so that the throttling expansion structure is formed at a joint of the first section and the second section; and/or the discharge control mechanism comprises an expansion hole provided in the scroll component, the pressure tapping hole is connected with the expansion hole through a first channel groove, the expansion hole is connected with the pressure control chamber through a second channel groove, and a flow cross-sectional area of the expansion hole is greater than a flow cross-sectional area of the first channel groove so that the throttling expansion structure is formed at a joint of the expansion hole and the first channel groove.

8. The according to claim 7, wherein the pressure tapping hole, the expansion hole and the blocking member passage section are arranged in different planes extending substantially along the axis direction of the compression mechanism.

9. The scroll compressor according to claim 6, wherein:

the scroll component further comprises a hub portion formed on a side, opposite to the scroll blade, of the scroll end plate, and the discharge passage and the discharge control mechanism are provided at the hub portion.

10. The scroll compressor according to claim 4, wherein the discharge control mechanism is configured to actively generate the pressure difference; and wherein the discharge control mechanism further comprises a pressure control passage provided in the scroll component and a solenoid valve arranged in an exterior of the scroll component, the pressure control passage comprises a first pressure control passage and a second pressure control passage extending substantially in a direction transverse to the axis direction of the compression mechanism, the first pressure control passage is connected to the solenoid valve and is in communication with the pressure control chamber, and the second pressure control passage is connected to the solenoid valve and is in communication with the central compression chamber or the fluid compression chamber located close to the central compression chamber.

11. The scroll compressor according to claim 10, wherein the solenoid valve has a first state and a second state, in a liquid-carrying operating condition of the compression mechanism, the solenoid valve is in the first state so as to communicate the first pressure control passage with the exterior of the compression mechanism, and in a non-liquid-carrying operating condition of the compression mechanism, the solenoid valve is in the second state so as to communicate the first pressure control passage with the second pressure control passage.

12. The scroll compressor according to claim 1, wherein the compression mechanism comprises a back pressure chamber, the scroll end plate comprises a first side on which the scroll blade is formed; the back pressure chamber is formed on a second side, opposite to the first side, of the scroll end plate to provide an axial sealing pressure to the scroll component, the back pressure chamber forms a pressure control chamber of the pressure control mechanism, a first end surface of the movable blocking member is exposed to the back pressure chamber, and a second end surface, opposite to the first end surface, of the movable blocking member is exposed to the discharge fluid compression chamber.

13. The scroll compressor according to claim 12, wherein:

the discharge passage is provided in the scroll end plate, the blocking member passage portion extends from the first side to the second side of the scroll end plate, and a pressure tapping opening, located on the second side of the scroll end plate, of the blocking member passage portion is provided in the back pressure chamber.

14. The scroll compressor according to claim 13, wherein the movable blocking member is configured as a piston, a piston end cover is further provided at the pressure tapping opening of the blocking member passage portion, the piston end cover is fixed to the scroll end plate to stop the piston, a through hole is formed in the piston end cover, and a first end, serving as the first end surface, of the piston is exposed to the back pressure chamber through the through hole.

15. The scroll compressor according to claim 12, wherein the back pressure chamber is in communication with a second fluid compression chamber of the fluid compression chambers through a pressure tapping hole provided in the scroll end plate, and the discharge fluid compression chamber is closer to a radially outer side of the compression mechanism than the second fluid compression chamber.

16. The scroll compressor according to claim 1, wherein the blocking member passage portion is configured as a single passage, and the liquid discharge portion is configured as a single passage or multiple passages, and the liquid discharge portion is in communication with the blocking member passage portion through a corresponding liquid outlet formed on a side part of the blocking member passage portion.

17. The scroll compressor according to claim 1, wherein the discharge passage comprises a plurality of discharge passages, and pressure control chambers within the plurality of discharge passages are in communication with each other through a communication groove.

18. The scroll compressor according to claim 1, wherein the discharge passage is configured in such a way that, when viewed in the axis direction of the compression mechanism, a part of the liquid entry section is overlapped with a part, where the liquid entry section is formed, of the orbiting scroll blade of the orbiting scroll, or overlapped with a part, where the liquid entry section is formed, of the fixed scroll blade of the fixed scroll.

19. The scroll compressor according to claim 10, further comprising a controller, wherein the controller is configured to control a solenoid valve, arranged outside the scroll component, of the compression mechanism and thus to control a movable blocking member arranged in the discharge passage, so that during start-up of the scroll compressor or in a case that it is detected that the scroll compressor is in a liquid-carrying operating condition, the discharge passage provides the fluid communication.

* * * * *